United States Patent [19]

Nakamura et al.

[11] 4,026,706

[45] May 31, 1977

[54] SILVER HALIDE MULTILAYER PHOTOSENSITIVE MATERIAL

[75] Inventors: Shinichi Nakamura; Hidehiko Ishikawa; Katsuo Mogaki; Mikio Sato, all of Odawara; Shui Sato, Hino; Masahiko Taguchi; Haruhiko Sato, both of Odawara, all of Japan

[73] Assignee: Konishiroku Photo Industry Co., Ltd., Tokyo, Japan

[22] Filed: June 21, 1974

[21] Appl. No.: 481,701

[30] Foreign Application Priority Data

July 2, 1973 Japan ..... 48-73608

[52] U.S. Cl. ..... 96/74; 96/56.5; 96/100

[51] Int. Cl.[2] ..... G03C 3/00; G03C 7/00; G03C 1/40

[58] Field of Search ..... 260/310; 96/100, 56.5, 96/74, 22, 55

[56] References Cited

UNITED STATES PATENTS

| | | | |
|---|---|---|---|
| 2,423,730 | 7/1947 | Salminen et al. | 96/100 X |
| 2,801,171 | 7/1957 | Fierke et al. | 96/100 X |
| 3,684,514 | 8/1972 | Iwama et al. | 96/56.5 X |
| 3,762,921 | 10/1973 | Van den Eynde et al. | 96/55 |

*Primary Examiner*—Edward C. Kimlin
*Assistant Examiner*—L. Falasco
*Attorney, Agent, or Firm*—Bierman & Bierman

[57] ABSTRACT

A silver halide photosensitive element using specifically defined yellow, magenta and cyan color couplers in the individual respectively blue, green and red-sensitive layers.

8 Claims, No Drawings

SILVER HALIDE MULTILAYER PHOTOSENSITIVE MATERIAL

This invention relates to a silver halide photosensitive material for color photography which has improved sensitivity, resolving power and color reproducibility.

Silver halide photosensitive materials for color photography comprise 3 silver halide emulsion layers formed on a support, these layers sensitized to blue, green and red rays, respectively.

For example, in a color negative film, blue-sensitive, green-sensitive and red-sensitive emulsion layers and generally formed in this order from the exposure side, and a bleachable yellow filter layer is formed between the blue-sensitive and green-sensitive emulsion layers to absorb blue rays permeating through the blue-sensitive emulsion layer. Further, intermediate layers having special activities are provided between every two emulsion layers and a protective layer is formed as the outermost layer. In the case of a color printing paper, red-sensitive, green-sensitive and blue-sensitive emulsion layers are generally formed in this order from the exposure side, and as in the case of the color negative film, intermediate layers inclusive of a ultraviolet absorbing layer and a protective layer are formed for respectively specific objects. It is known that the emulsion layers can be disposed in an order different from the above-mentioned order, and although one layer is generally formed as each of the three emulsion layers differing in the sensitive region, it is also known that two emulsion layers sensitive to substantially the same wavelength region are used as one of the above three emulsion layers. A yellow coupler forming a yellow dye image, a magenta coupler forming a magenta dye image and a cyan coupler forming a cyan dye image are incorporated in the above blue-sensitive, green-sensitive and red-sensitive emulsion layers, respectively. These color-forming couplers are divided into 4 equivalent couplers and 2 equivalent couplers. In the case of the former couplers in order to form one molecule of a dye, 4 molecules of the silver halide should be developed, and in the case of the latter couplers, two molecules of the silver halide should be developed for forming one molecule of a dye. These couplers are appropriately chosen and used depending on the intended purpose.

In general, couplers are selected in view of the following conditions and requirements:

When development is conducted with a color developing solution comprising as the main ingredient a color developing agent such as a p-phenylene diamine derivative, a coupler is reacted with an oxidation product of the color developing agent to form a dye. The coupler is required to have as high a reaction rate as possible, namely as high a color coupling rate as possible. Further, the dye formed by this coupling reaction is required to have good hue and good stability against light, heat, moisture and the like. Moreover, the coupler should have such properties that it does not cause photographic properties of the silver halide photosensitive material by its interaction with photographic additives present in the silver halide photosensitive material, such as a sensitizing dye and the like. It is also required that the coupler should have good storage stability and it should be synthesized at a low cost.

However, it is very difficult to select couplers capable of meeting all of the above requirements. Although there have been found respective photosensitive emulsion layers having a yellow coupler, a magenta coupler or a cyan coupler, which are relatively satisfactory when used individually, it is very difficult to find photosensitive emulsion layers capable of meeting the above requirements when they are combined with other photosensitive materials to form collective silver halide photosensitive materials for color photography.

Among the above requirements, the color coupling rate is desired to be as high as possible. However, if the color coupling rate is too high, the upper layer is developed more promptly than the lower layer because of the difference of permeation of the liquid developer into the photosensitive material, and hence, the developing effect becomes uneven among the layers of the photosensitive material. Accordingly, it is desired that each of couplers of respective laminated photosensitive emulsion layers has a color coupling rate which is high to some extent and the couplers are substantially identical in respect to the color coupling rate. However, since the couplers of the respective emulsion layers exhibit different coupling rates, it is quite difficult to find a combination of yellow coupler, a magenta coupler and a cyan coupler, all of which exhibt substantially same coupling rates in respective photosensitive emulsion layers and can meet the other requirements such as mentioned above. In short, there has not been developed a silver halide photosensitive material for color photography, in which the color coupling rate is substantially the same among yellow, magenta and cyan couplers in respective photosensitive emulsion layers and all of the above-mentioned requirements are satisfied. In the case of a silver halide photosensitive material for color photography in which coloring coupling rates of couplers in respective photosensitive emulsion layers are not uniform, at the step of color development an oxidation product of the color developing agent is diffused into other photosensitive emulsion layers and insufficient dye is left in the photosensitive emulsion layer, while an excessive amount of dye is formed in the other photosensitive emulsion layers. The result is color turbidity loss of color balance in the resulting colored image. Accordingly, in conventional silver halide photosensitive materials for color photography, respective photosensitive emulsion layers cannot be disposed directly adjacent to one another, and intermediate layers are provided so as to prevent an oxidation product of the color developing agent formed in a photosensitive emulsion layer having a low color coupling rate, from diffusing into other photosensitive emulsion layers and thus breaking down the color balance in the resulting image. In order to attain this object satisfactorily however, it is necessary to provide an intermediate layer having a considerable thickness; for example, a thickness larger than I $\mu$. If such thick intermediate layer is provided, the thickness of a photosensitive coating of the silver halide photosensitive material for color photography should naturally be increased, which results in reduction of the sensitivity and resolving power. Further, permeation of the liquid developer is inhibited to some extent by provision of such thick layer, and therefore, most of the conventional silver halide photosensitive materials for color photography are not suitable for the quick development treatment.

It is therefore a primary object of this invention to provide a novel silver halide photosensitive material for color photography which comprises yellow, magenta and cyan couplers having substantially the same high color coupling rate in respective photosensitive emulsion layers differing in the sensitive wavelength region and which is substantially improved in sensitivity, resolving power, image color sharpness, color reproducibility, storage stability and other properties.

SUMMARY OF THE INVENTION

We have found that the above object can be attained by incorporating at least one yellow coupler represented by the following general formula [I] into a blue-sensitive silver halide emulsion layer, material for color photography, at least one magenta coupler represented by the following general formula [II] into a green-sensitive silver halide emulsion layer, structural layer, and at least one cyan coupler represented by the following general formula [III] into a red-sensitive silver halide emulsion layer.

General Formula [I]

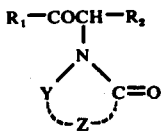

[I]

In the above general formula, $R_1$ stands for an alkyl, alkenyl, aryl or heterocyclic group which may be substituted, $R_2$ stands for a cyano group or an N-phenylcarbamyl group which may be substituted, Y is a group —CO—, —$SO_2$—, —N=, —CH= or C ≡ , and Z is a non-metallic atomic group necessary for formation of a 4-, 5- or 6-membered nitrogen-containing heterocyclic ring.

General Formula [II]

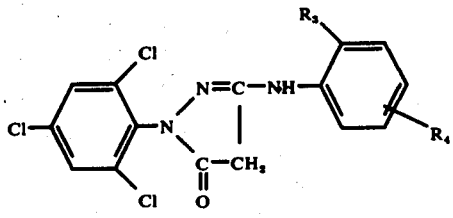

[II]

In the above general formula, $R_3$ stands for a hydrogen or halogen atom or a nitro, alkyl, alkoxy or acylamino group, and $R_4$ stands for a hydrogen or halogen atom or a mono-valent organic residue such, for example, as nitro, alkyl, alkoxy and acylamino groups and optionally substituted carbamoyl, sulfamoyl, alkylsuccinimide, alkoxycarboamide, alkoxycarboalkylamino, aralkoxycarboalkylamino, alkylaminocarboalkylamino, arylaminocarboalkylamino and aralkylaminocarboalkylamino groups.

General Formula [III]

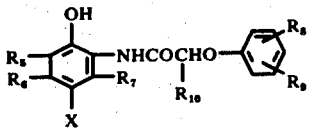

[III]

In the above formula, $R_5$, $R_6$ and $R_7$ stand for a hydrogen or halogen atom or an alkyl, aryl or alkoxy group, $R_8$ and $R_9$ stand for a hydrogen atom or an alkyl or alkoxy group, $R_{10}$ is a hydrogen atom or an alkyl group, and X designates an atom or group splittable upon coupling.

A silver halide photosensitive material of this invention including these couplers is characterized in that each of couplers respective photosensitive emulsion layers differing in the sensitive wavelength region has a considerably high color coupling rate and their coupling rates are substantially identical. Therefore, in the silver halide photosensitive material of this invention, the color coupling reaction proceeds simultaneously at substantially the same rate in all of the photosensitive emulsion layers, and hence, the thickness of an intermediate layer formed to prevent an oxidation product of the color developing agent from diffusing into an adjacent layer can be greatly reduced. In some combination of appropriately selected yellow, magenta and cyan couplers, provision of such intermediate layer can be omitted. Further, since each coupler has a considerably high color coupling rate as pointed above, the coupling reaction proceeds substantially simultaneously in respective photosensitive emulsion layers, regardless of the order of lamination of these photosensitive emulsion layers. Accordingly, in the silver halide photosensitive material of this invention, it is possible to form a green-sensitive emulsion layer, a green-sensitive layer and a red-sensitive layer on a support in an optional order. It is also possible to construct one photosensitive emulsion layer by employing two photosensitive emulsion layers having a photosensitivity in substantially the same wavelength region. In this invention, an intermediate layer of a suitable thickness may optionally be provided so as to attain other objects than prevention of diffusion of an oxidation product of the color developing agent. It is also possible to provide other layers customarily used in photosensitive materials, such as ultraviolet absorbing a protective layers. In this invention, good sensitivity, resolving power and color reproducibility can be attained regardless of the layer structure in the photosensitive material and the order of lamination of layers. The fact that such desirable results can be obtained in this invention is owing to the combined use of the above-mentioned three specific couplers.

Couplers used in this invention, namely a yellow coupler represented by the general formula [I], a magenta coupler represented by the general formula [II] and a cyan coupler represented by the general formula [III], are incorporated in the silver halide photosensitive material for color photography so that each coupler is prevented from diffusing into other layer from the silver halide emulsion layer in which the coupler is incorporated. Incorporation of such couplers into a silver halide emulsion is accomplished by a method comprising dissolving a coupler into a high-boiling-point organic solvent having a boiling point higher than 175° C., such as tricresyl phosphate and dibutyl phthalate, a low-boiling-point organic solvent such as ethyl acetate and butyl propionate, or a mixed solvent thereof, mixing the solution with an aqueous solution of gelatin containing a surface active agent, emulsifying and dispersing the mixture by a high speed rotary mixer or a colloid mill, and incorporating the resulting dispersion into a silver halide emulsion directly or after setting the dispersion, finely dividing the set dispersion and removing the low-boiling-point solvent by water washing or the like. It is preferred that the coupler is incorporated in the silver halide emulsion in an amount of 10 to 300 g per mole of the silver halide, but needless to say, the amount of the coupler can be broadly changed depending on the kind of the coupler, the intended use and other factors.
As typical instances of the yellow coupler represented by the general formula [I], the following compounds can be mentioned:
(Y-1)
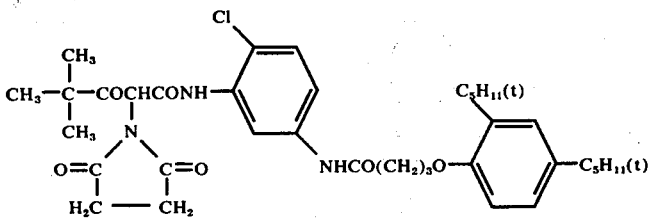
(Y-2)
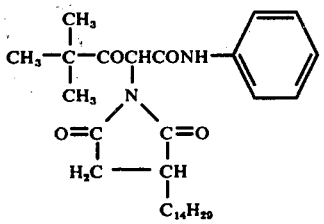
(Y-3)
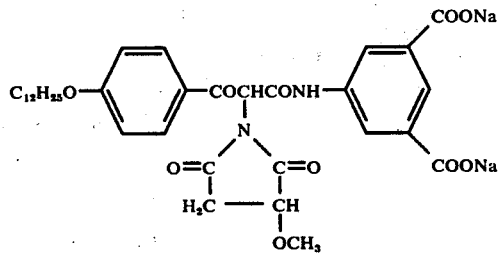
(Y-4)
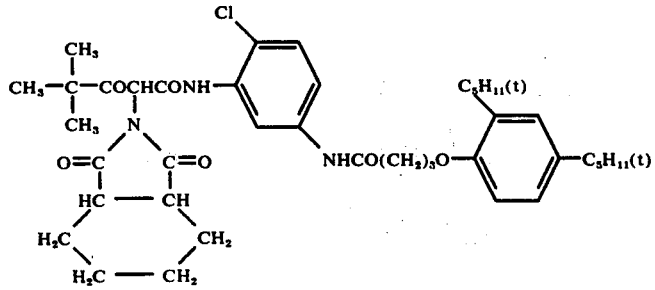
(Y-5)
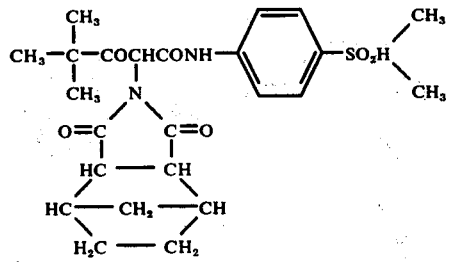
(Y-6)

-continued
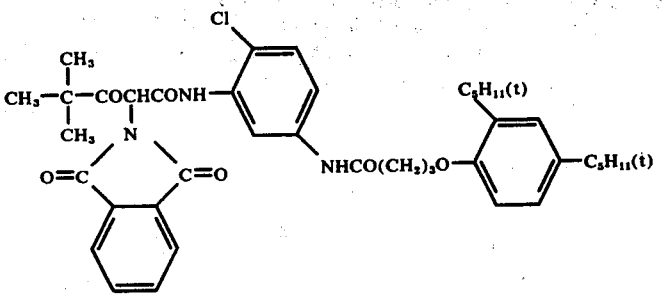
(Y-7)
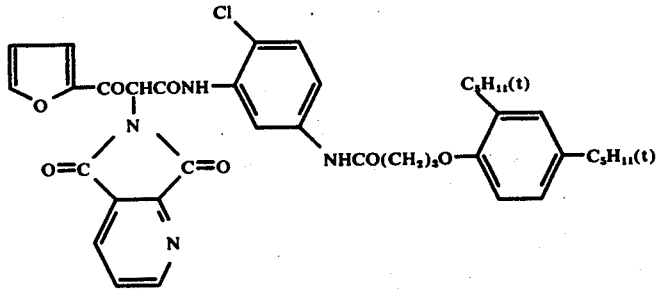
(Y-8)
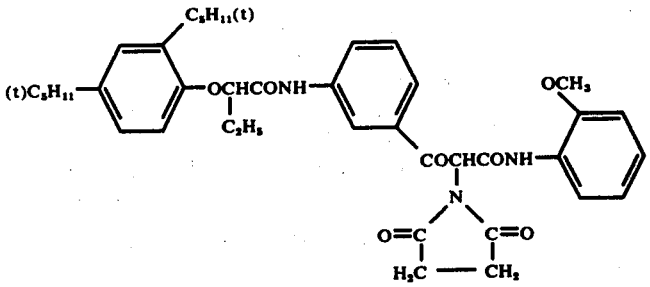
(Y-9)
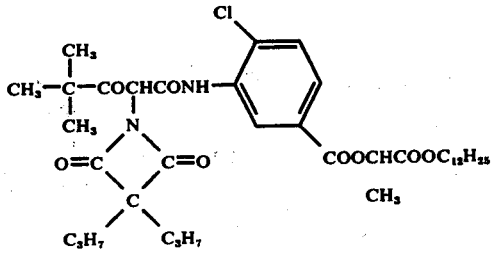
(Y-10)
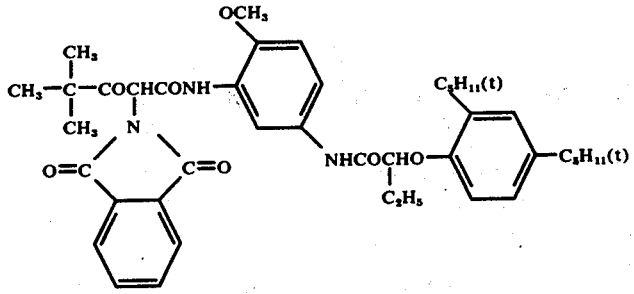
(Y-11)

-continued
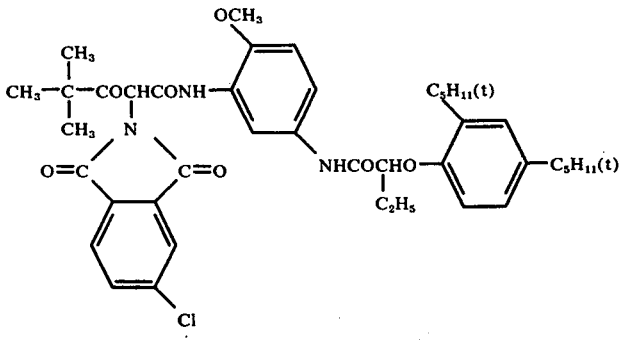
(Y-12)
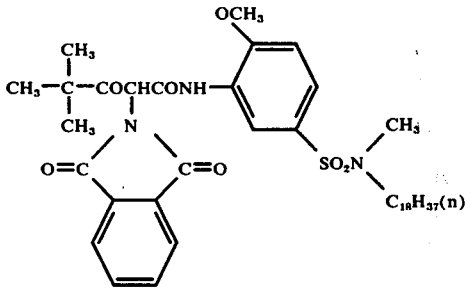
(Y-13)
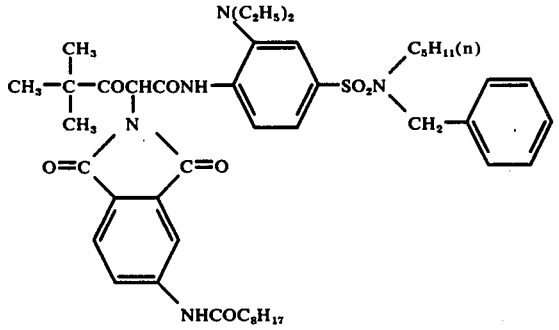
(Y-14)
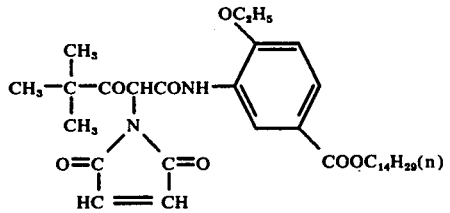
(Y-15)
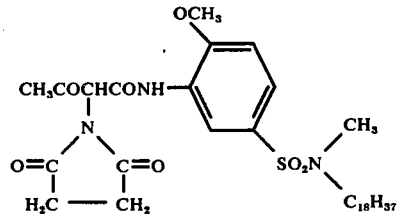
(Y-16)

-continued
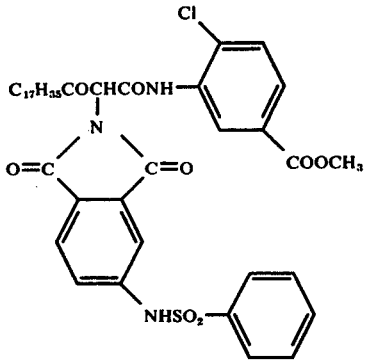
(Y-17)
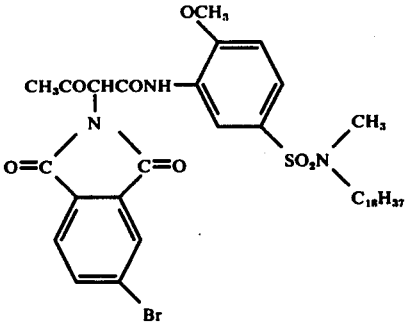
(Y-18)
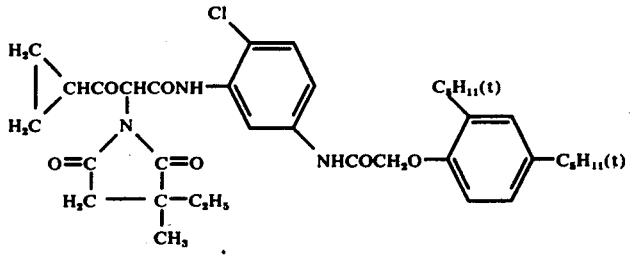
(Y-19)
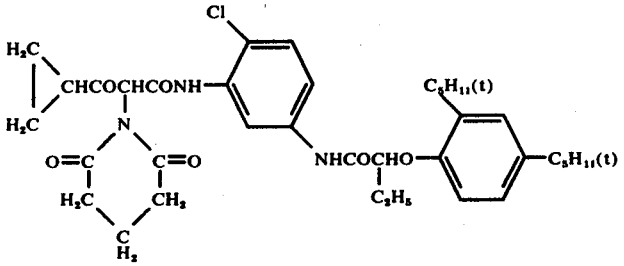
(Y-20)
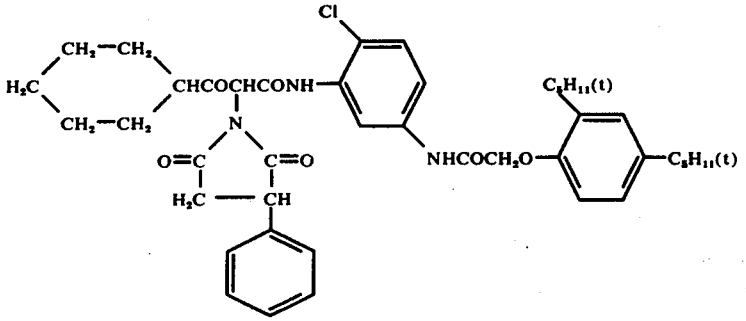
(Y-21)

-continued
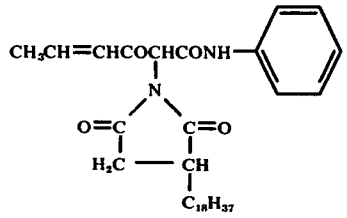
(Y-22)
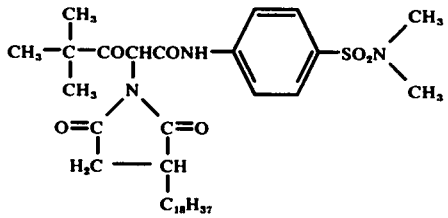
(Y-23)
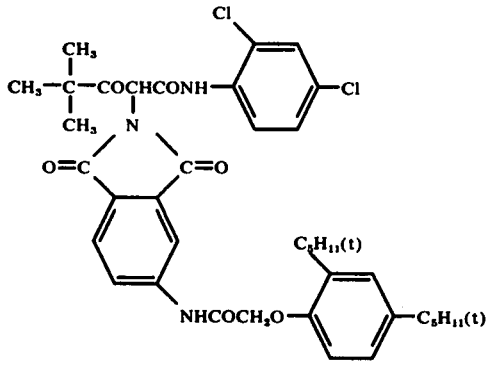
(Y-24)
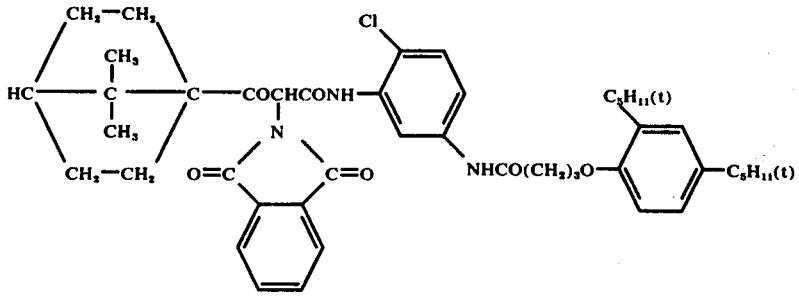
(Y-25)
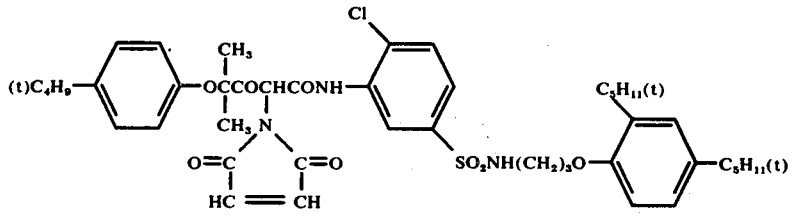
(Y-26)

-continued
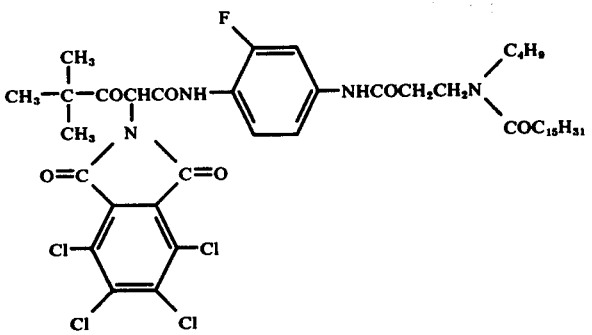
(Y-27)
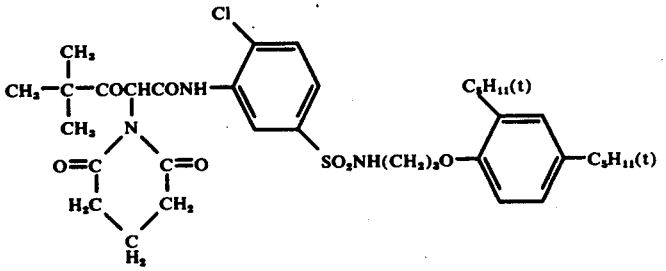
(Y-28)
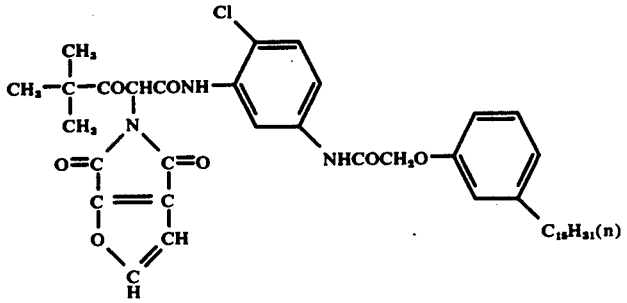
(Y-29)
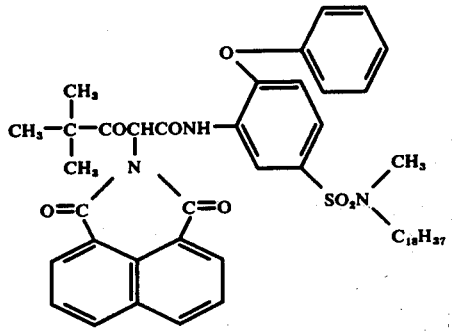
(Y-30)
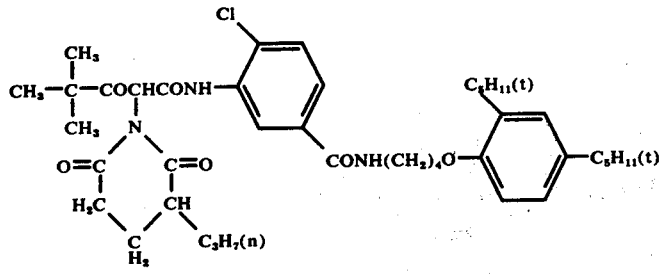
(Y-31)

-continued
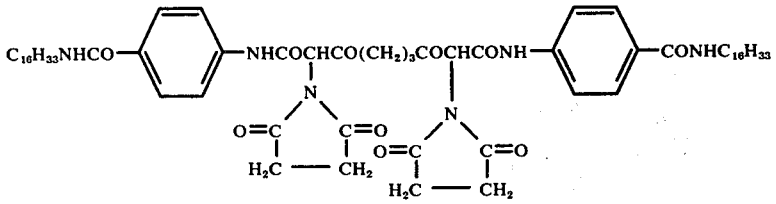
(Y-32)
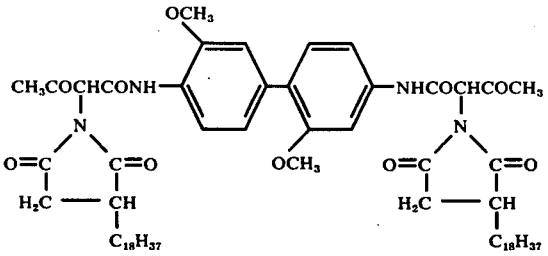
(Y-33)
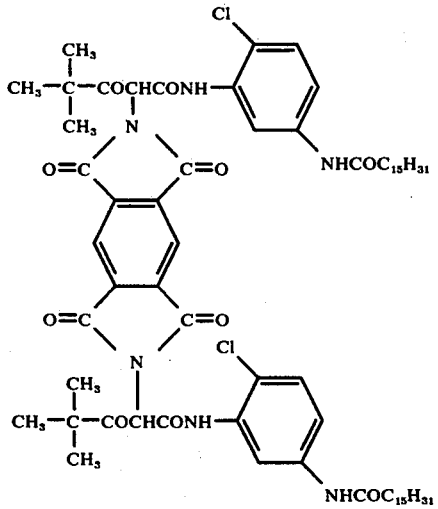
(Y-34)
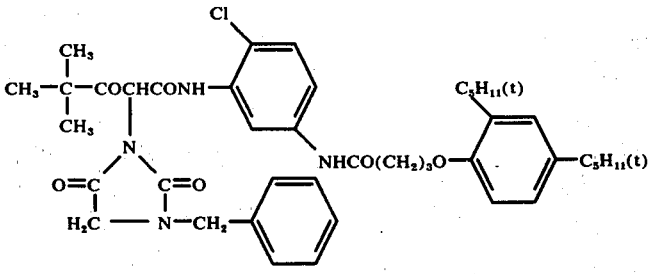
(Y-35)
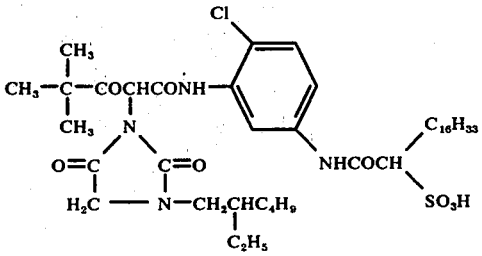
(Y-36)

-continued
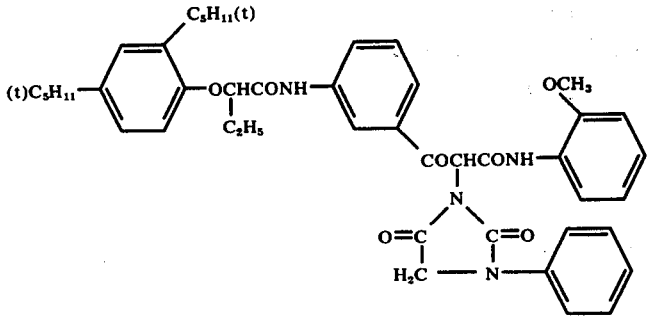
(Y-37)
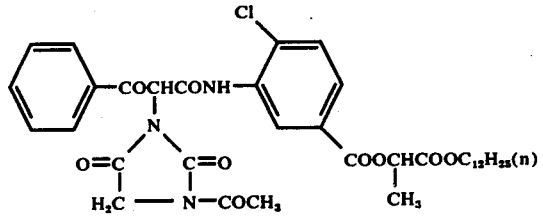
(Y-38)
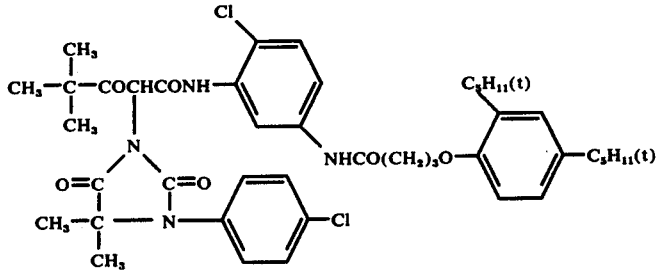
(Y-39)
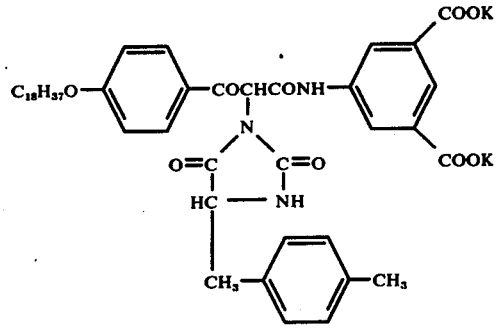
(Y-40)
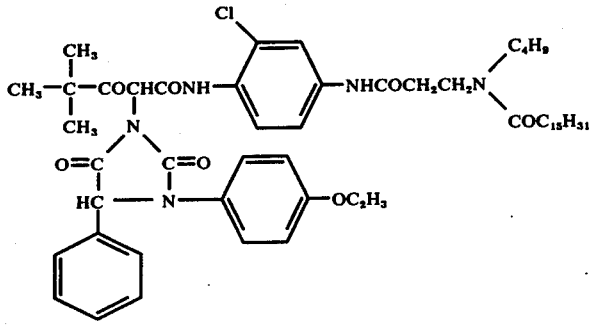
(Y-41)

-continued
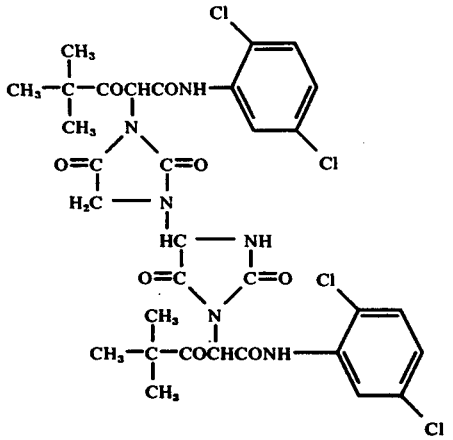
(Y-42)
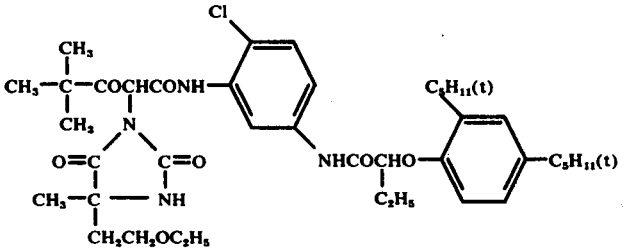
(Y-43)
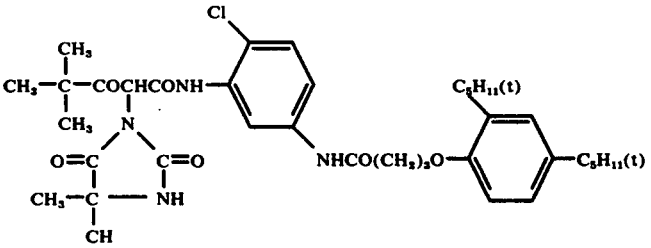
(Y-44)
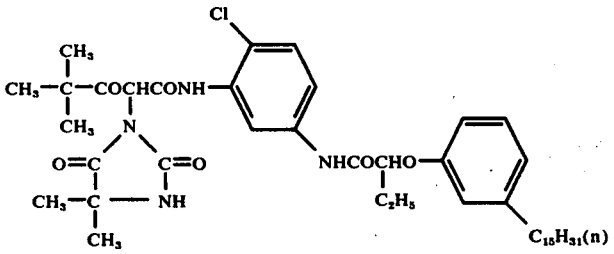
(Y-45)
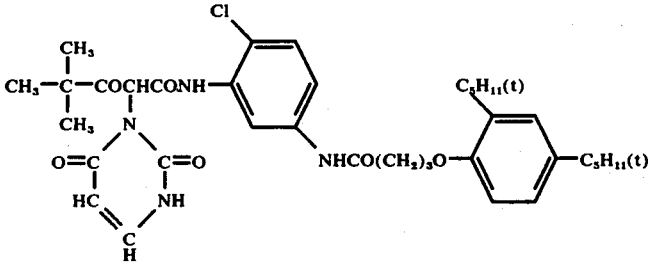
(Y-46)

-continued
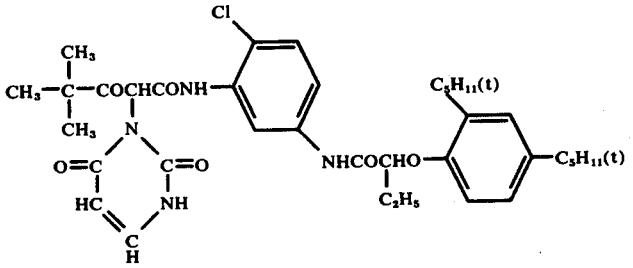
(Y-47)
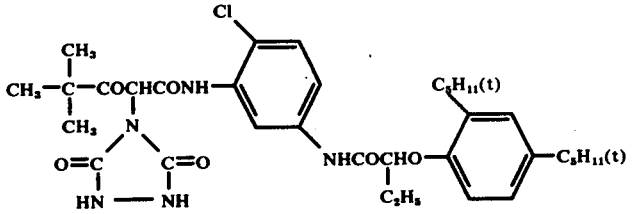
(Y-48)
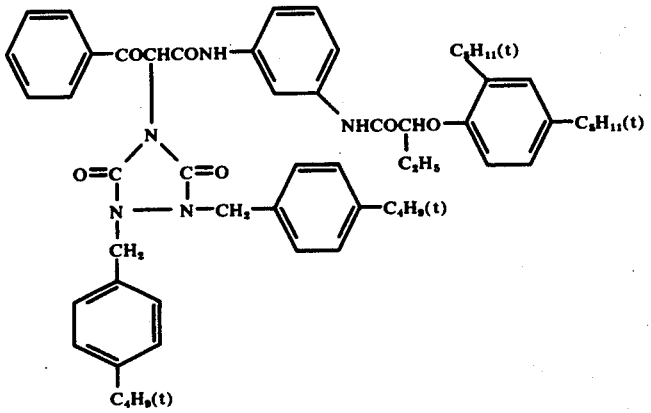
(Y-49)
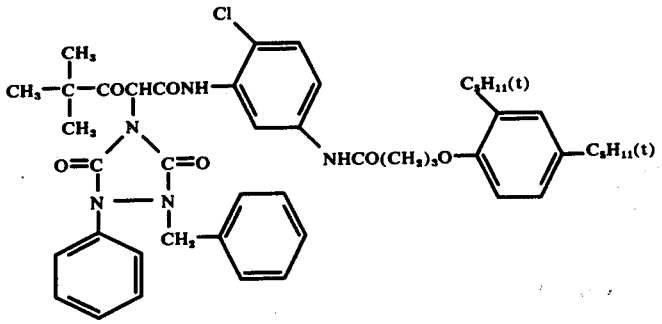
(Y-50)
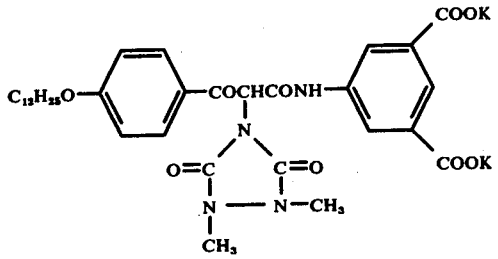
(Y-51)

-continued
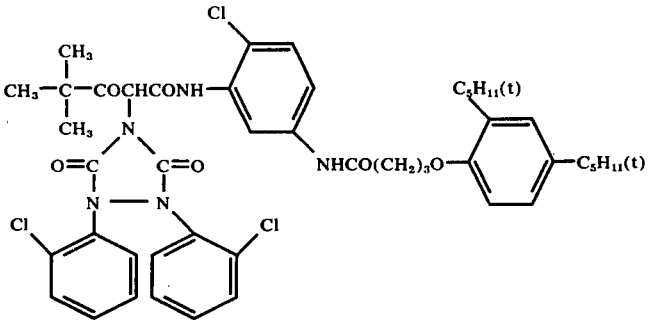
(Y-52)
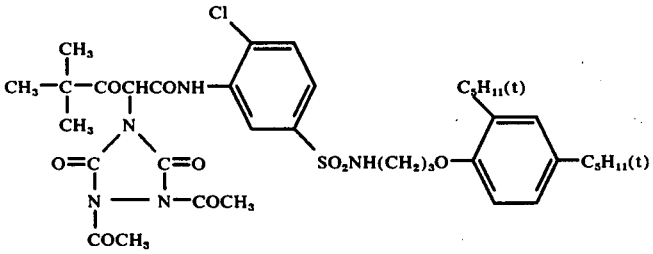
(Y-53)
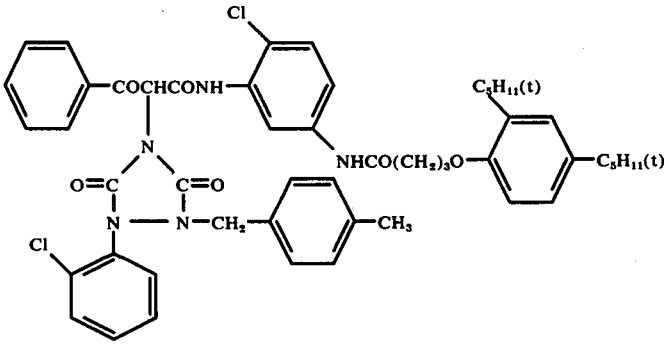
(Y-54)
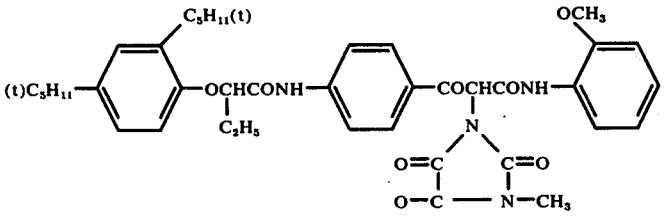
(Y-55)
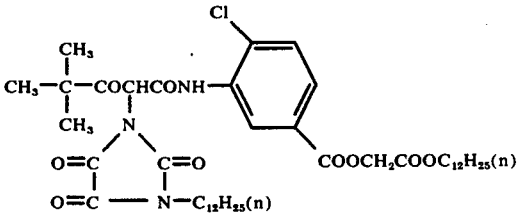
(Y-56)

-continued
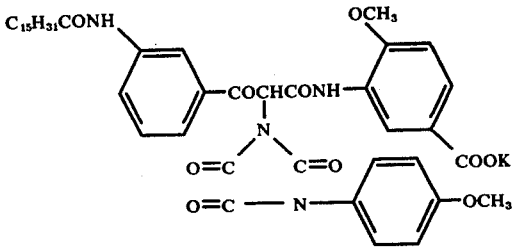
(Y-57)
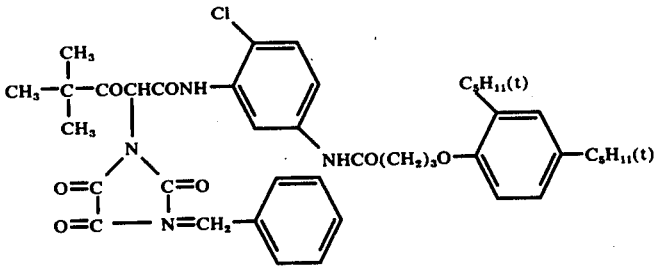
(Y-58)
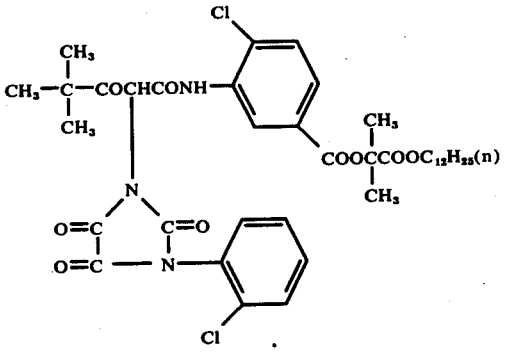
(Y-59)
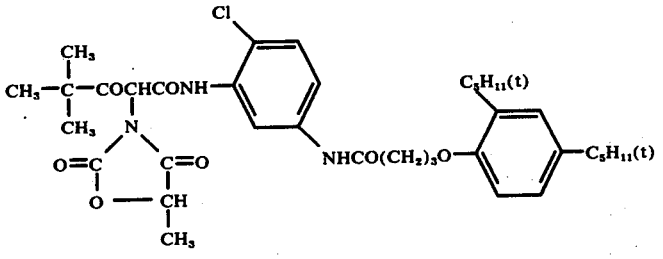
(Y-60)
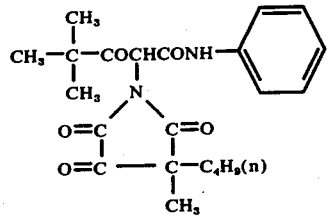
(Y-61)

-continued
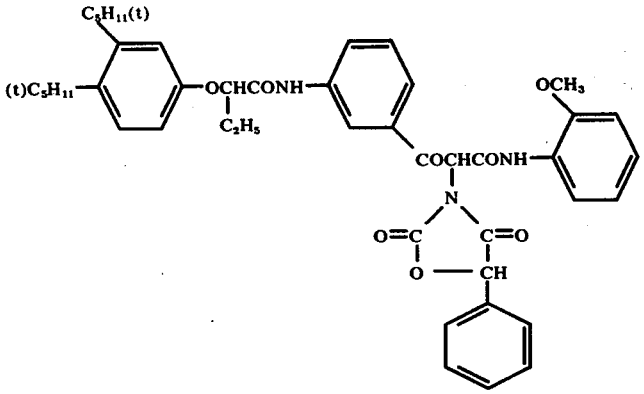
(Y-62)
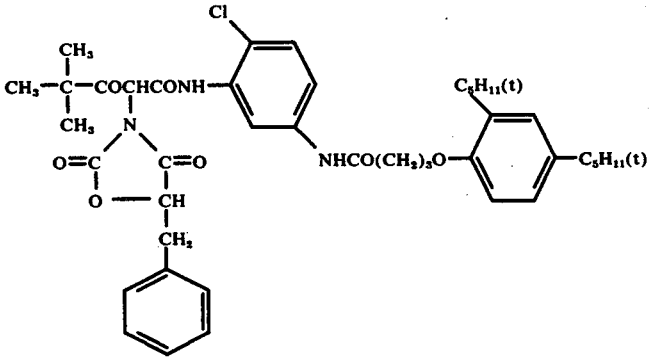
(Y-63)
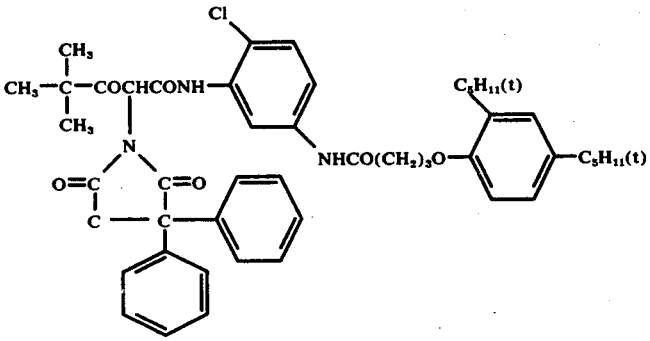
(Y-64)
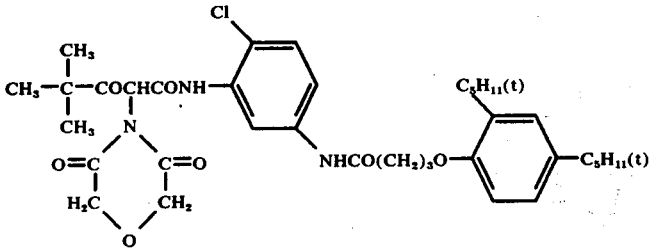
(Y-65)

-continued
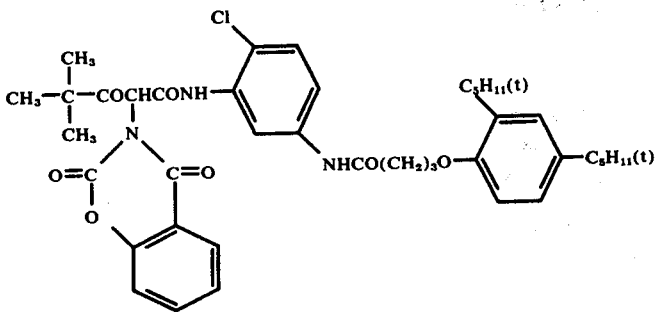
(Y-66)
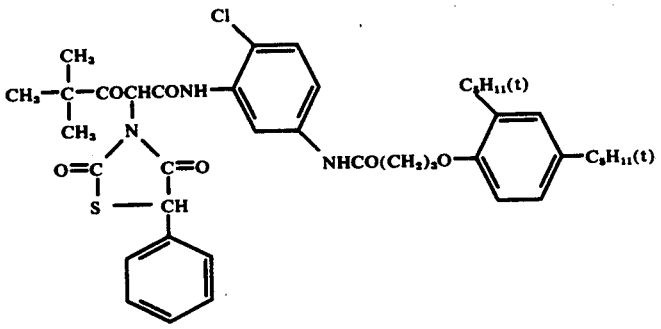
(Y-67)
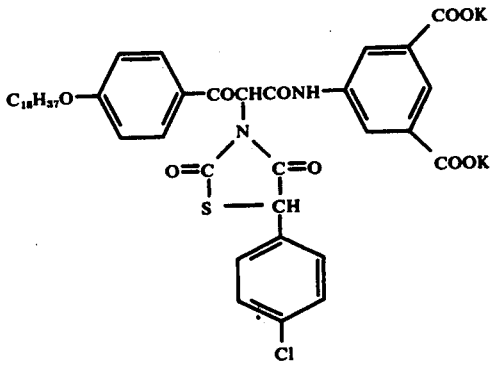
(Y-68)
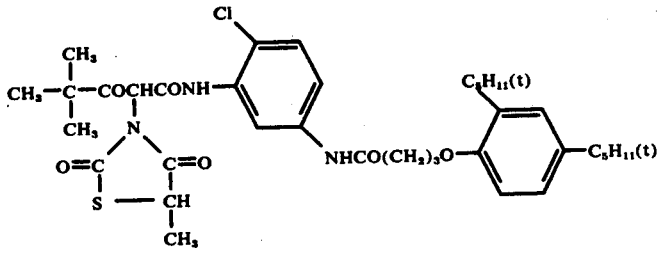
(Y-69)
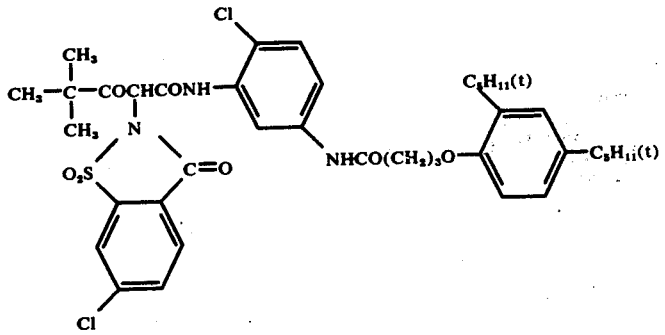

-continued
(Y-70)
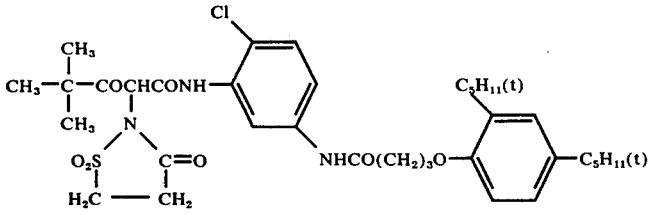
(Y-71)
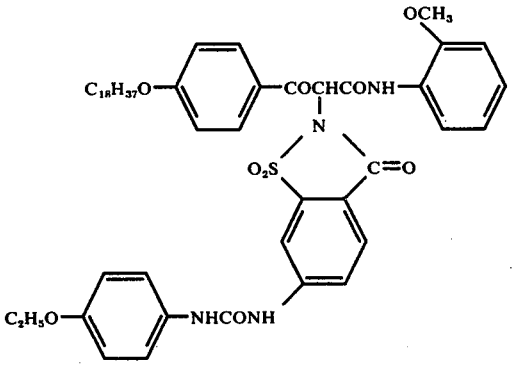
(Y-72)
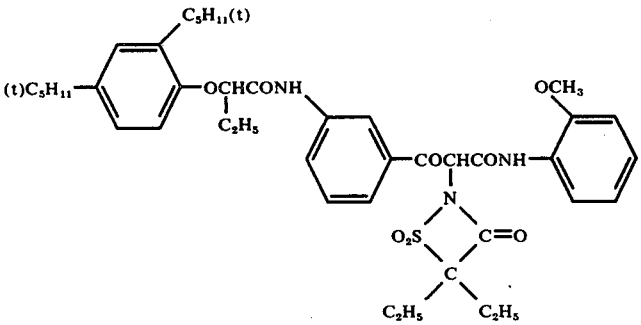
(Y-73)
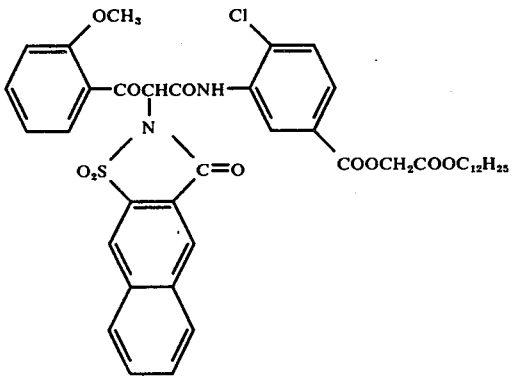
(Y-74)

-continued
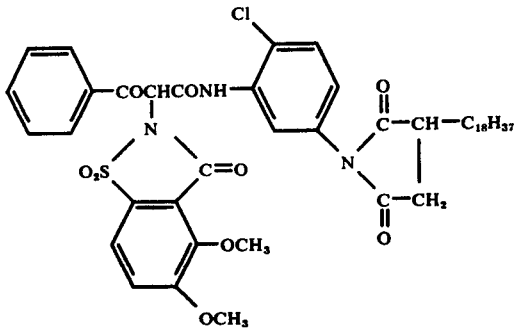
(Y-75)
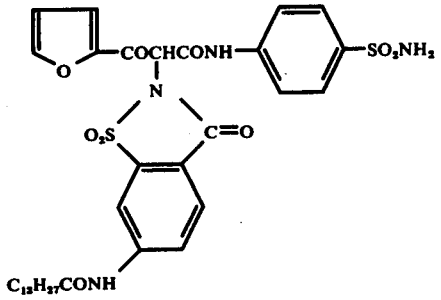
(Y-76)
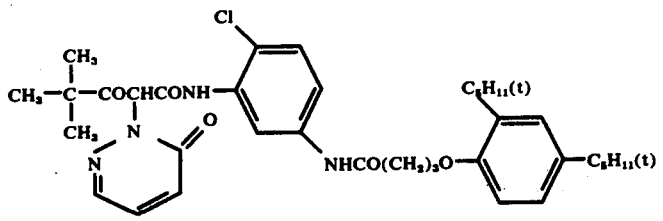
(Y-77)
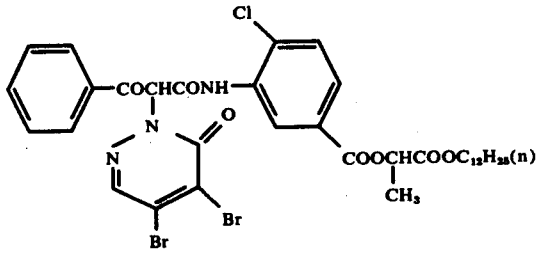
(Y-78)
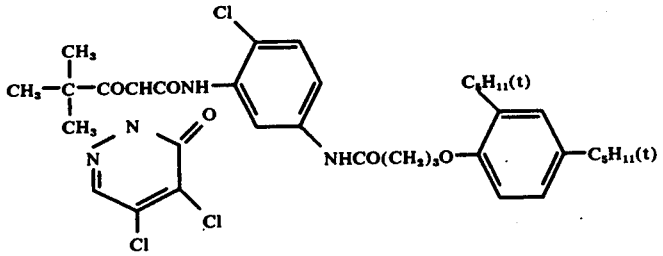
(Y-79)

-continued
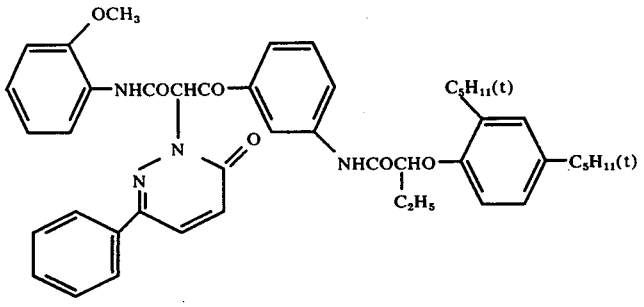
(Y-80)
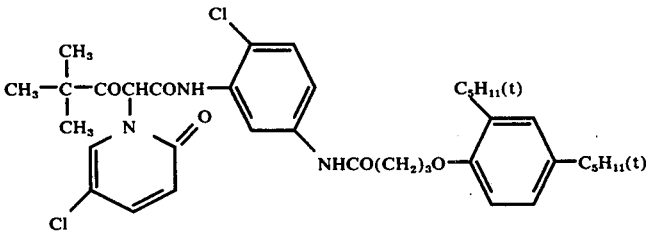
(Y-81)
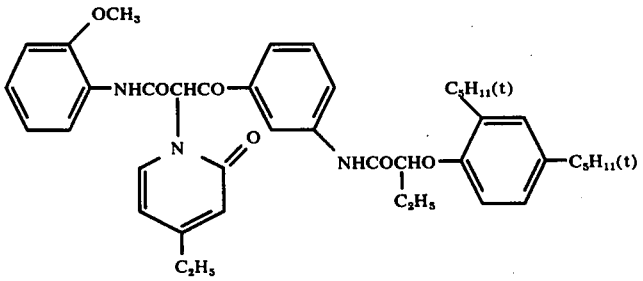
(Y-82)
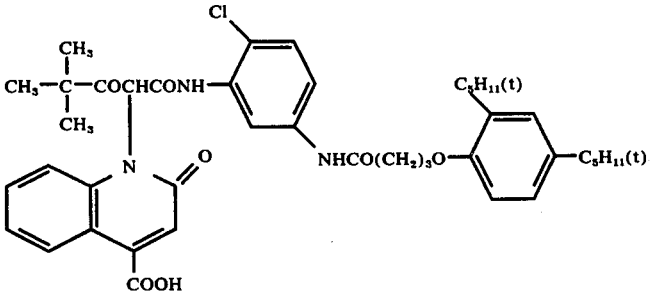
(Y-83)
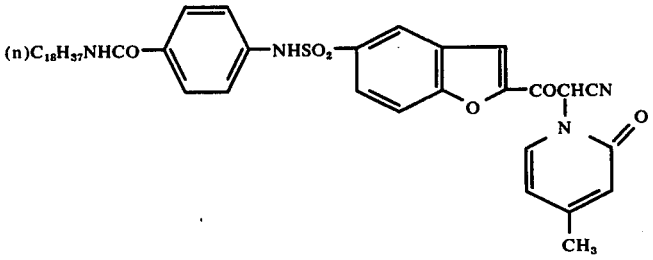
These yellow couplers can be synthesized according to methods disclosed in, for example, Japanese Patent Applications No. I0I848/7I, No. IOI85O/7I, No. 25754/72, No. 37367/72 and No. 52I79/72.
As typical instances of the magenta couplers represented by the general formula [II], the following compounds can be mentioned:

(M-1)
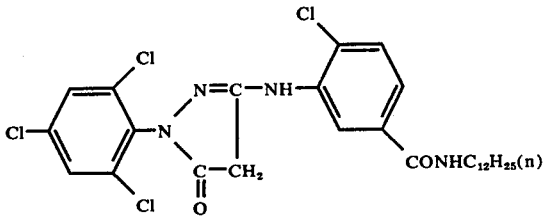
(M-2)
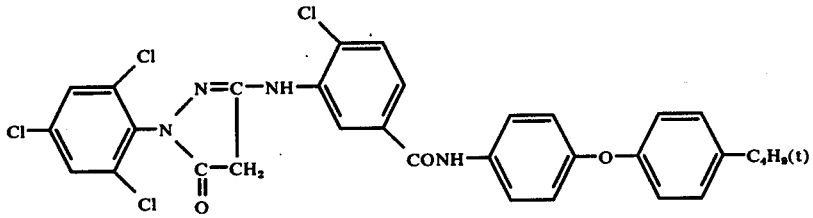
(M-3)
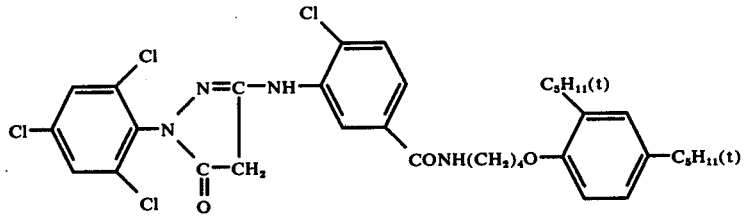
(M-4)
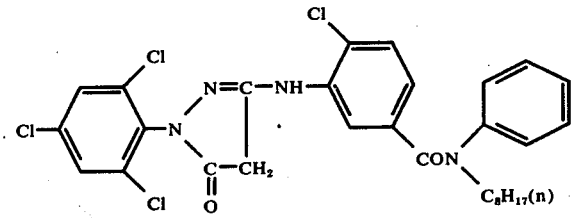
(M-5)
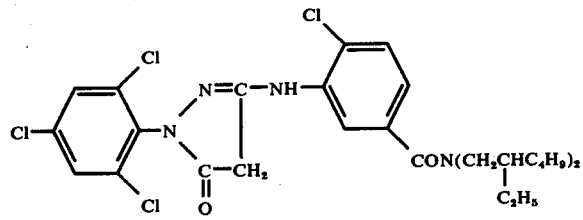
(M-6)
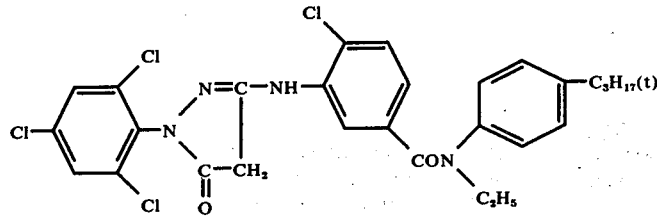
(M-7)

-continued
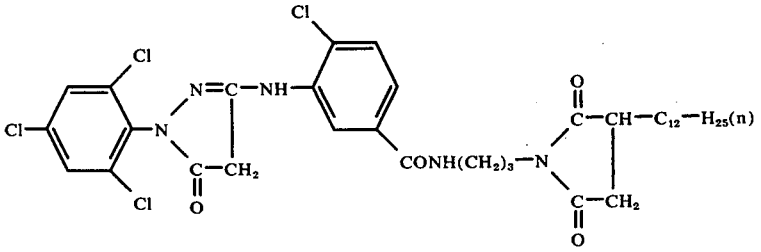
(M-8)
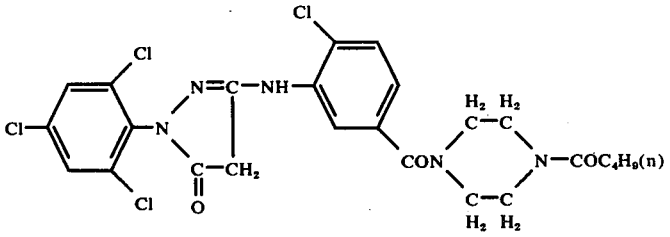
(M-9)
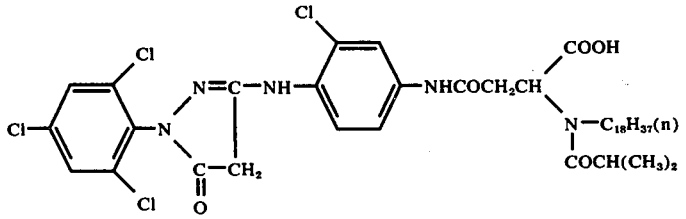
(M-10)
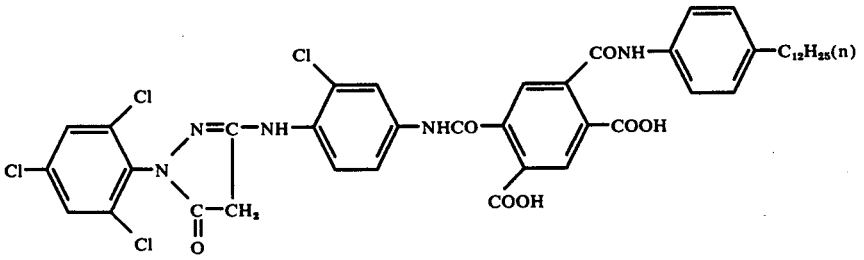
(M-11)
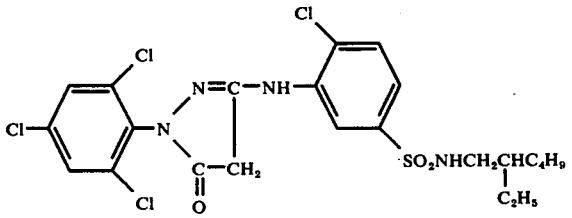
(M-12)
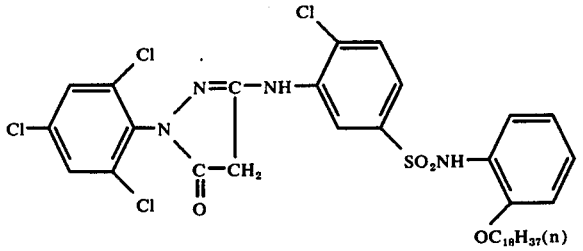
(M-13)

-continued
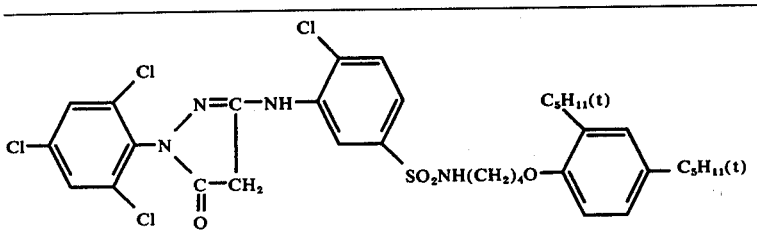
(M-14)
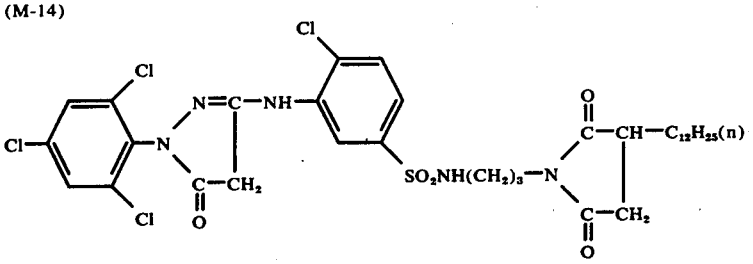
(M-15)
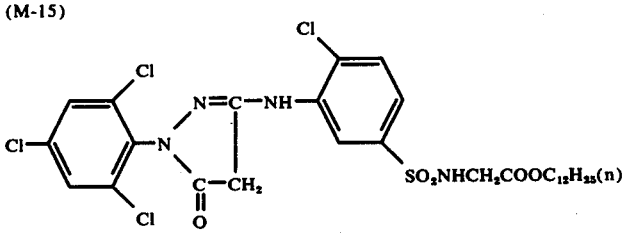
(M-16)
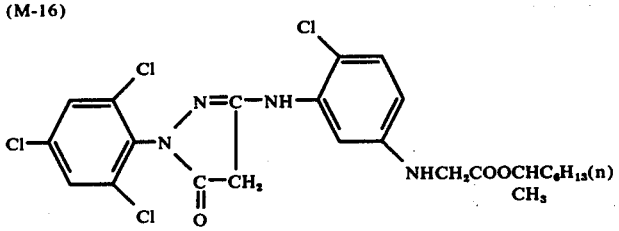
(M-17)
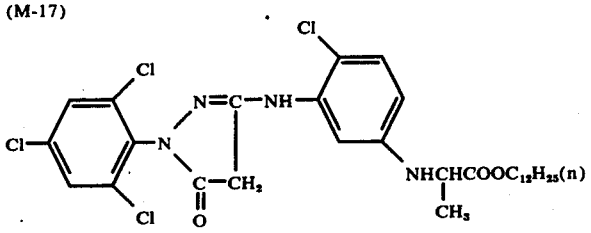
(M-18)
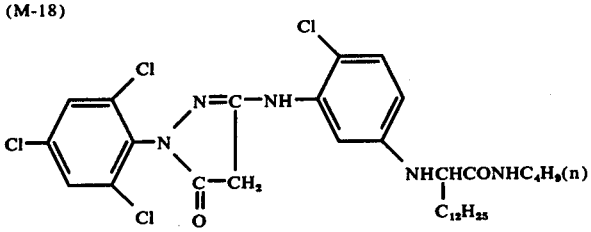
(M-19)
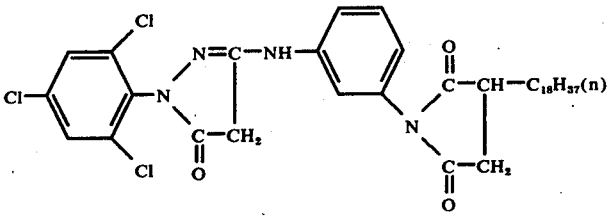

-continued
(M-20)
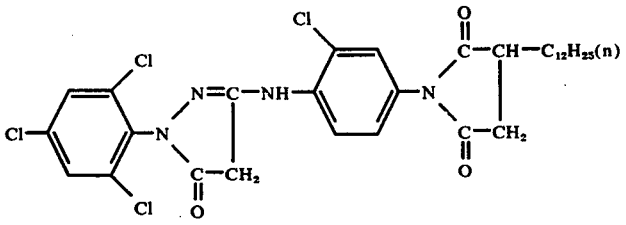
(M-21)
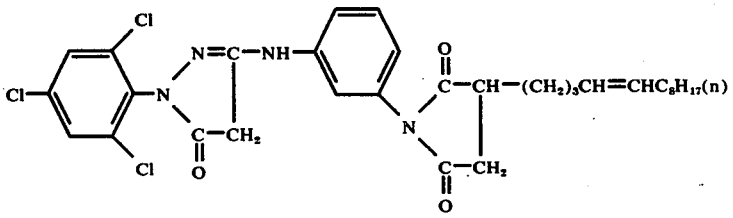
(M-22)
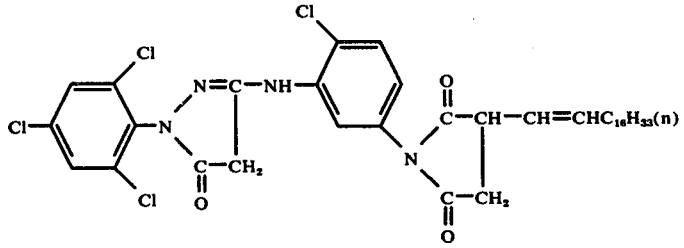
(M-23)
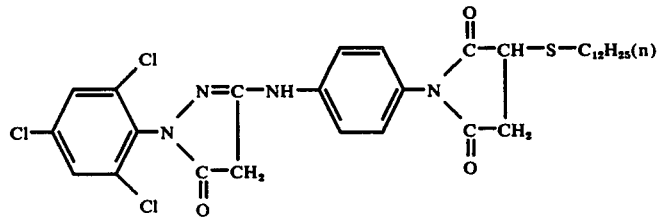
(M-24)
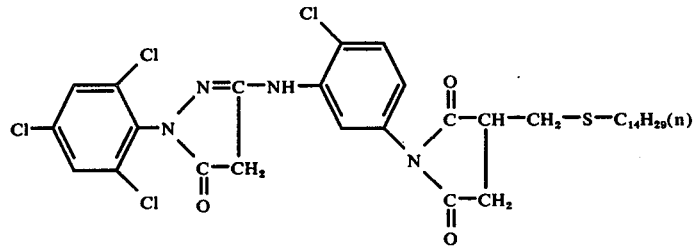
(M-25)
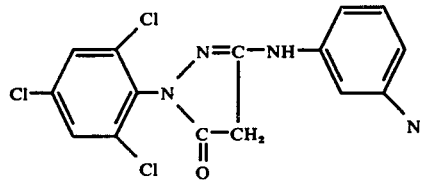
(M-26)

-continued
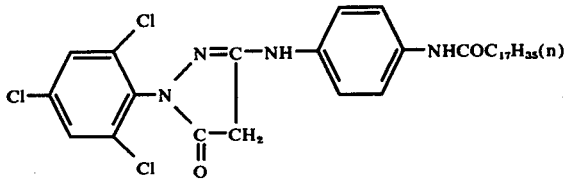
(M-27)
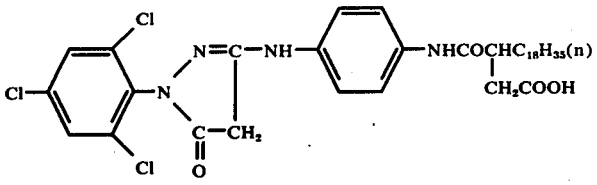
(M-28)
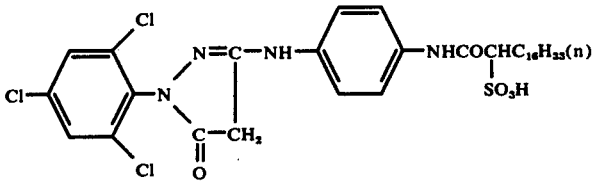
(M-29)
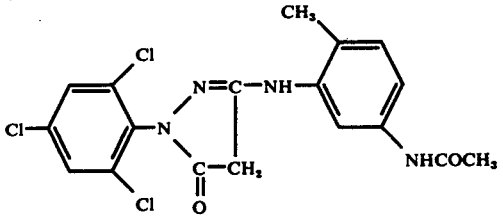
(M-30)
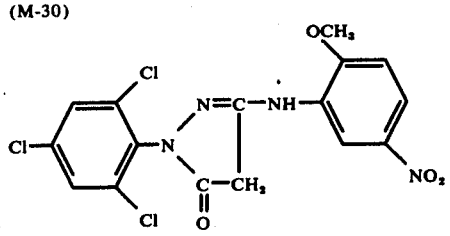
(M-31)
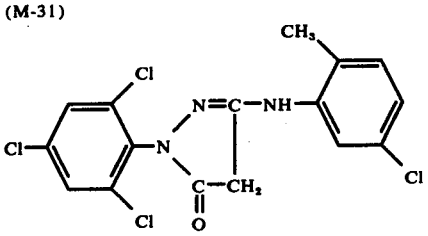
(M-32)
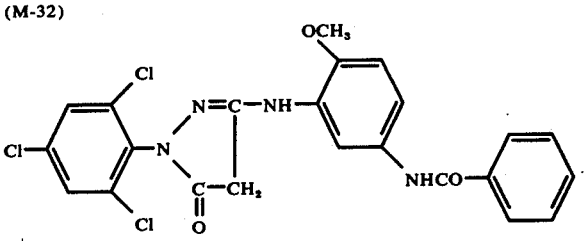
(M-33)

-continued
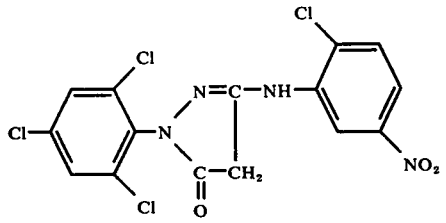
(M-34)
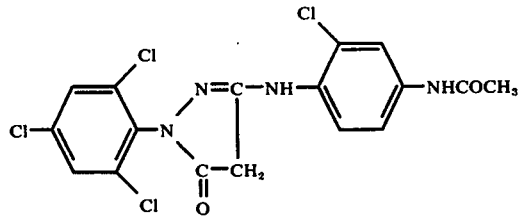
(M-35)
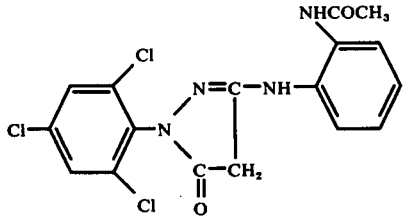
(M-36)
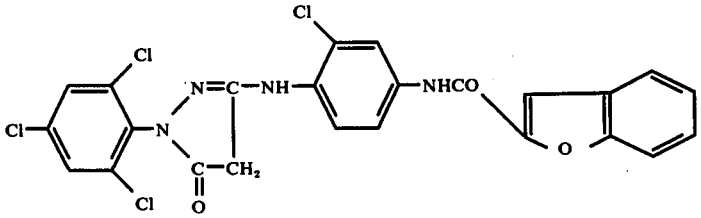
(M-37)
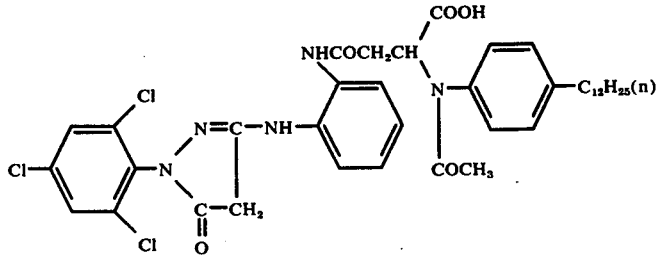
(M-38)
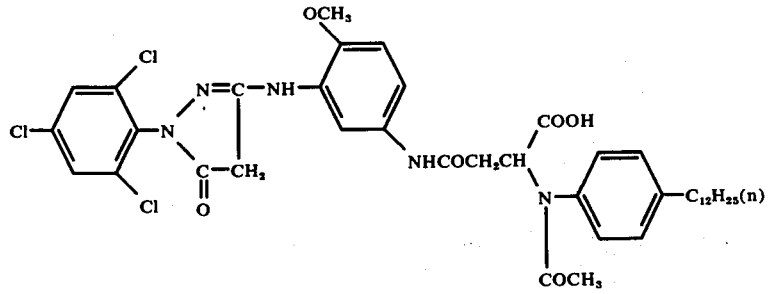
(M-39)

-continued
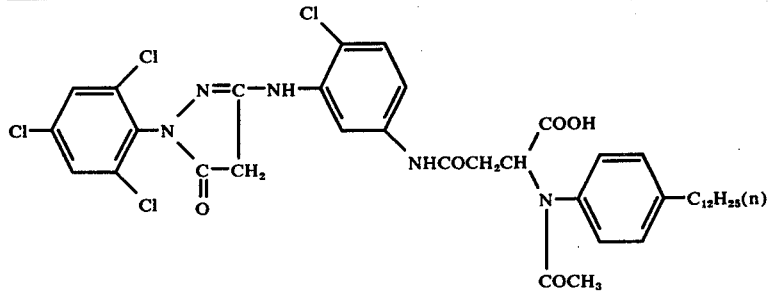
(M-40)
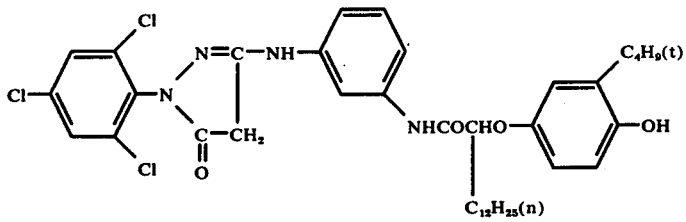
(M-41)
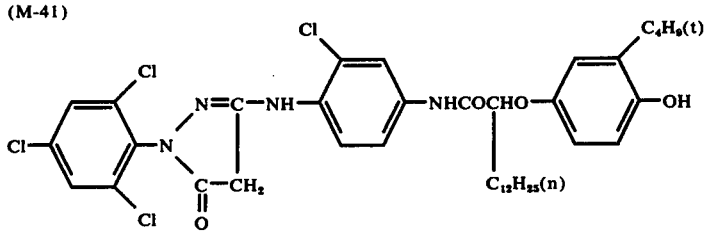
(M-42)
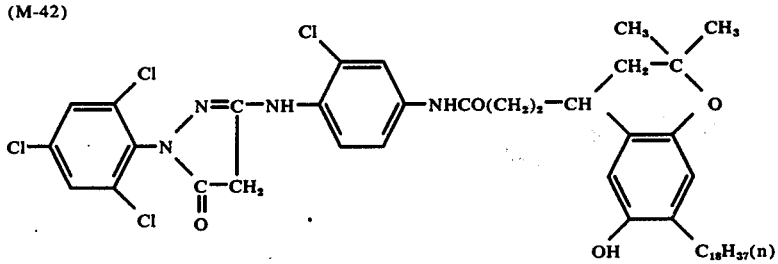
(M-43)
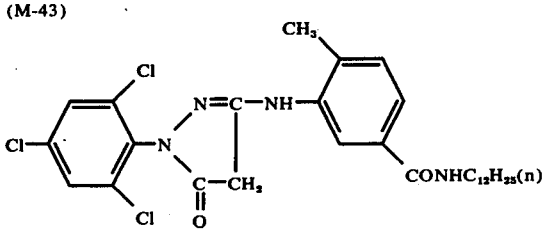
(M-44)
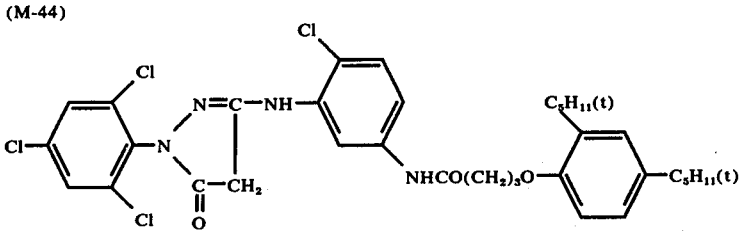
These magenta couplers can be synthesized according to methods disclosed in, for example, U.S. Pat. No. 3,684,514.
As typical instances of the cyan coupler represented by the general formula [III] the following compounds can be mentioned:

(C-1)
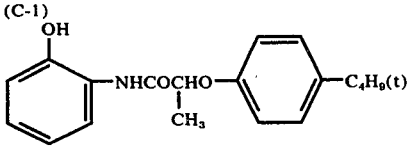
(C-2)
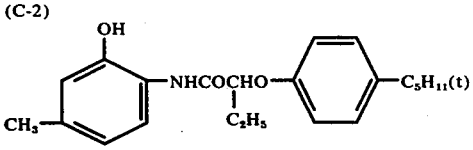
(C-3)
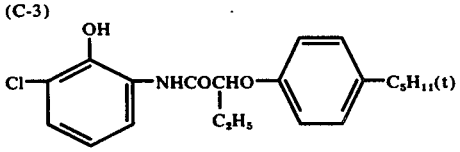
(C-4)
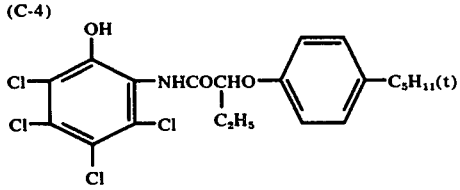
(C-5)
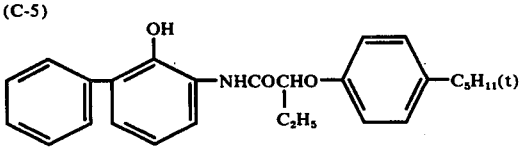
(C-6)
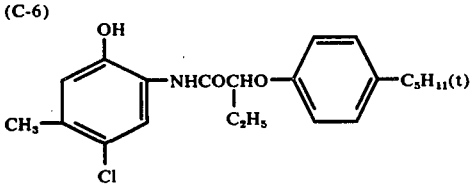
(C-7)
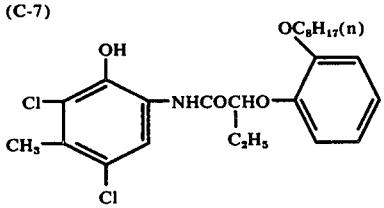
(C-8)
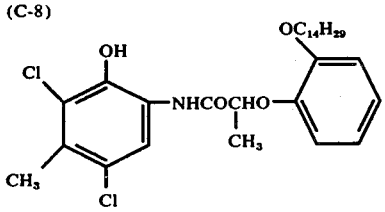
(C-9)
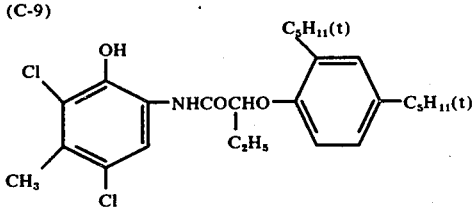
(C-10)
-continued
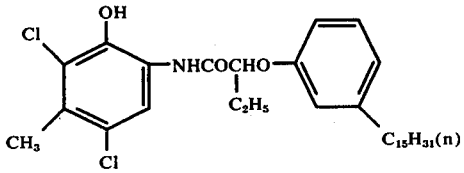
(C-11)
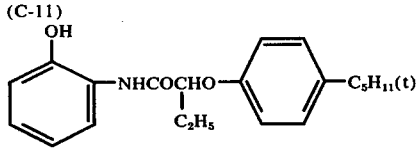
(C-12)
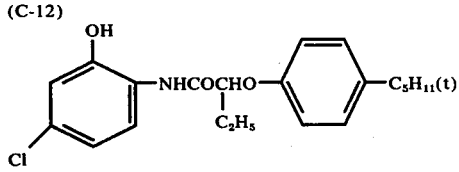
(C-13)
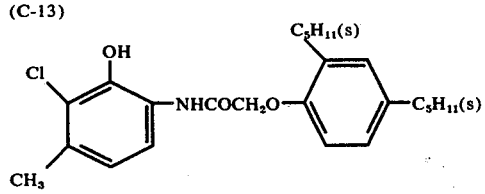
(C-14)
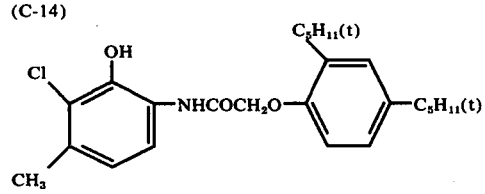
(C-15)
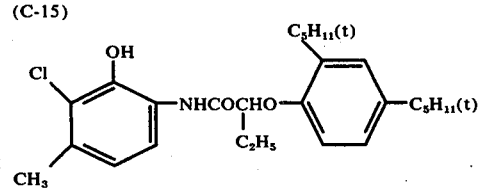
(C-16)
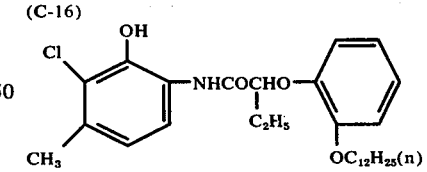
(C-17)
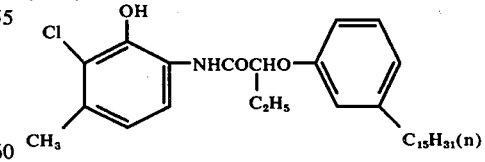
(C-18)
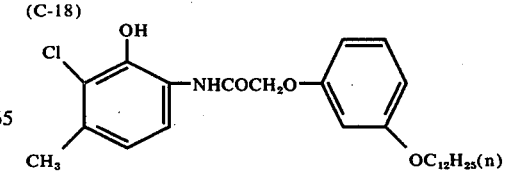
(C-19)

-continued
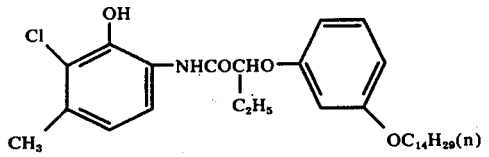
(C-20)
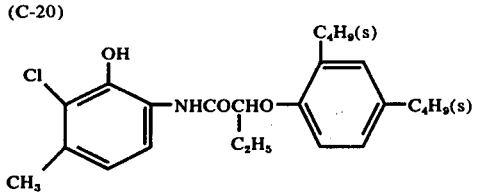
(C-21)
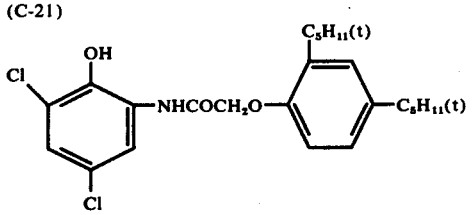
(C-22)
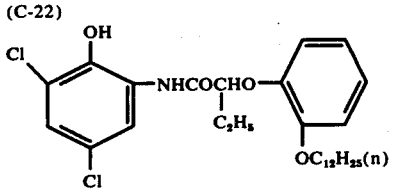
(C-23)
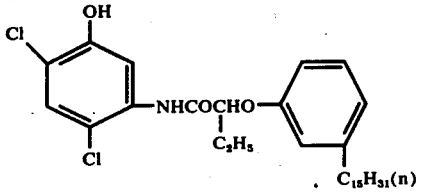
(C-24)
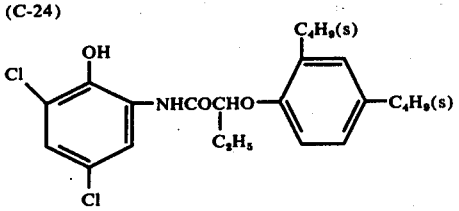
(C-25)
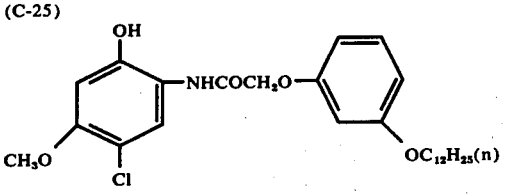
(C-26)
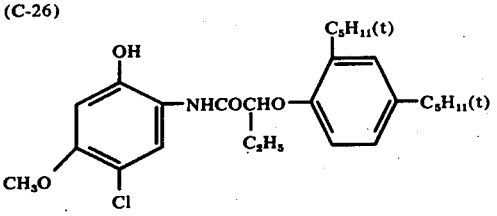
(C-27)
-continued
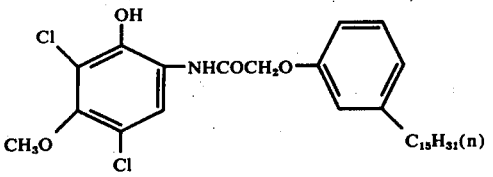
(C-28)
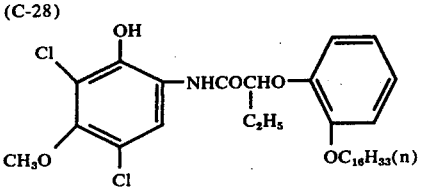
(C-29)
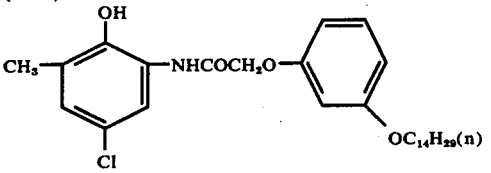
(C-30)
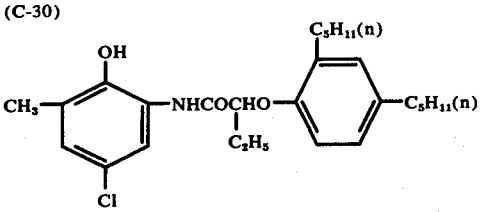
(C-31)
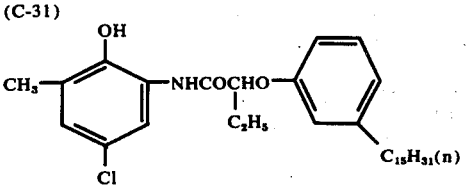
(C-32)
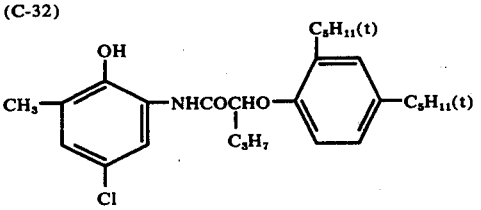
(C-33)
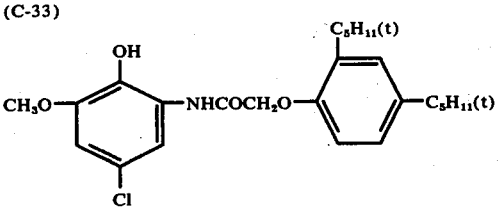
(C-34)
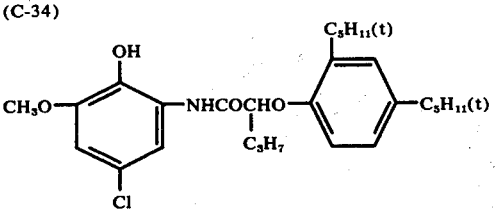
(C-35)

-continued

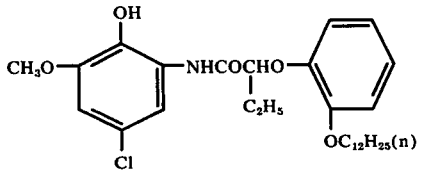

(C-36)

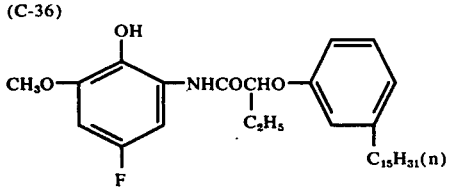

(C-37)

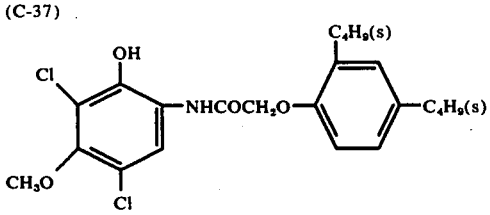

(C-38)

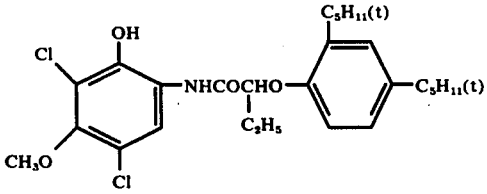

(C-39)

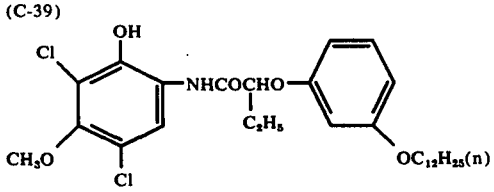

(C-40)

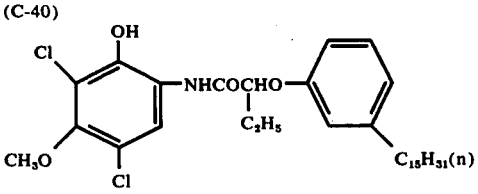

(C-41)

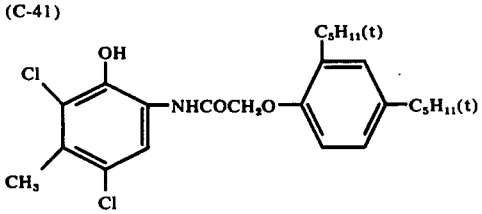

(C-42)

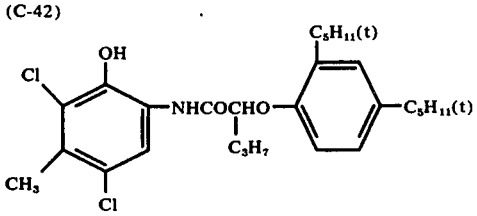

(C-43)

-continued

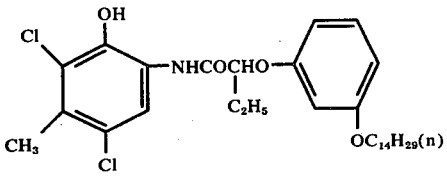

(C-44)

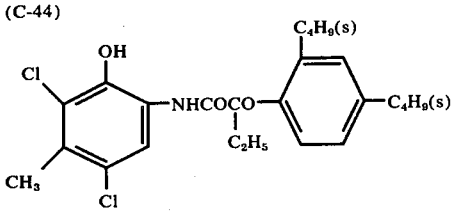

(C-45)

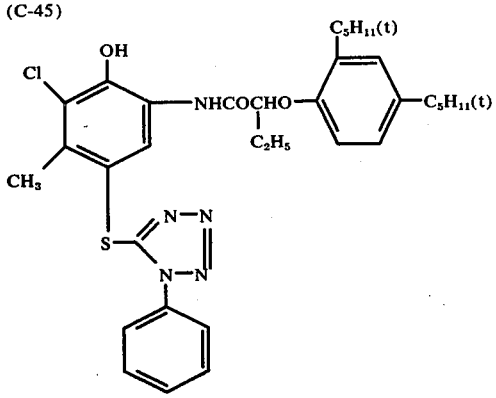

(C-46)

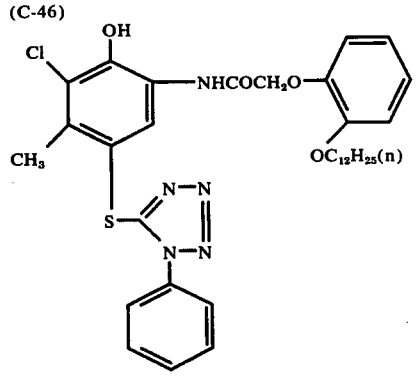

These cyan couplers can be synthesized according to methods disclosed in, for example, U.S. Pat. Nos. 2423,730; 2801,171; and 3737,318.

Hydrophilic colloids advantageously used for forming a photosensitive emulsion of the silver halide photosensitive material for color photography according to this invention include gelatin, colloidal albumin, agar, gum arabic, alginic acid, cellulose derivatives such as cellulose acetate hydrolyzed up to an acetyl content of 19 to 26 %, acrylamide, imidated polyacrylamide, zein, urethanecarboxylic or cyanoacetyl group-containing vinyl alcohol polymers such as vinyl alcoholvinyl cyanoacetate copolymer, polyvinyl alcohol, polyvinylpyrrolidone, hydrolyzed polyvinyl acetate, polymers obtained by polymerizing protein or saturated acyl-modified protein with a vinyl group-containing monomer, and the like.

Any of silver halides ordinarily used for silver halide photographic emulsions can be used in this invention.

For example, there can be employed silver bromide, silver chloride, silver iodobromide, silver chlorobromide, silver chloroiodobromide and the like.

The silver halide emulsion to be used for formation of the silver halide photosensitive material for color photography according to this invention can be prepared according to all of various customary methods and known methods, for instance, methods such as disclosed in Japanese Patent Publication No. 7772/71 and methods such as disclosed in U.S. Pat. No. 2,592,250. More specifically, there can be adopted a method for preparing so called conversion emulsions by forming an emulsion of particles of silver salts including at least one silver salt having a solubility higher than that of silver bromide and converting at least a part of the particles to silver bromide or silver iodobromide, and a method for preparing Lippmann emulsions including a finely divided silver halide having an average particle size not exceeding 0.I$\mu$.

So formed silver halide emulsions can be sensitized by chemical sensitizers, such as sulfur sensitizers, e.g., allylthiocarbamide, thiourea, allyl isocyanate and cysteine, active or inactive selenium sensitizers, noble metal sensitizers such as gold compounds, e.g., potassium chloroaurate, auric trichloride, potassium auric thiocyanate and 2-aurosulfohenzothiazole methochloride, palladium compounds, e.g., ammonium chloropalladate and sodium chloropalladite, platinum compounds, e.g., potassium chloroplatinate, ruthenium compounds, rhodium compounds and iridium compounds, and the like. Sensitization can be accomplished by employing two or more of these sensitizers in combination. In addition to the chemical sensitization, reduction sensitization using a reducing agent can be applied to the emulsion of this invention. Further, the emulsion of this invention can be stabilized by triazoles, imidazoles, azaindenes, benzothiazonium compounds, zinc compounds, cadmium compounds, mercaptans and mixtures thereof. It is also possible to incorporate into the emulsion of this invention a sensitizing compound of the thioether, quaternary ammonium salt, or polyalkylene oxide type. Further, wetting agents, plasticizers and film property-improving agents such as dihydroxyalkanes, e.g., glycerin and I,5-pentanediol, ethylene-bis-glycolic acid esters, bis-ethoxydiethyleneglycol succinate, and water-dispersible, finely divided granular macromolecular compounds, can be incorporated into the emulsion of this invention. Moreover, various photographic additives, for example, film-hardening agents such as ethyleneimine compounds, dioxane derivatives, hydroxy polysaccharide, dicarboxylic chlorides and diesters of methanesulfonic acid, coating assistants such as saponin and salts of sulfosuccinic acid, fluorescent whitening agents, antistatic agents and anti-staining agents may also be included.

Blue-sensitive, green-sensitive and red-sensitive emulsions to be used for formation of a silver halide photosensitive material for color photography are optically sensitized by employing suitable sensitizing dyes so that they are rendered sensitive to desired wavelength regions respectively. Various sensitizing dyes can be used, and two or more sensitizing dyes can be used in combination. Sensitizing dyes advantageously used in this invention will now be described.

Typical instances of the sensitizing dye used for the blue-sensitive emulsion include cyanine dyes, merocyanine dyes and composite cyanine dyes such as disclosed in U.S. Pats. Nos. 2108,485 and 2161,331, and cyanine dyes such as shown below:

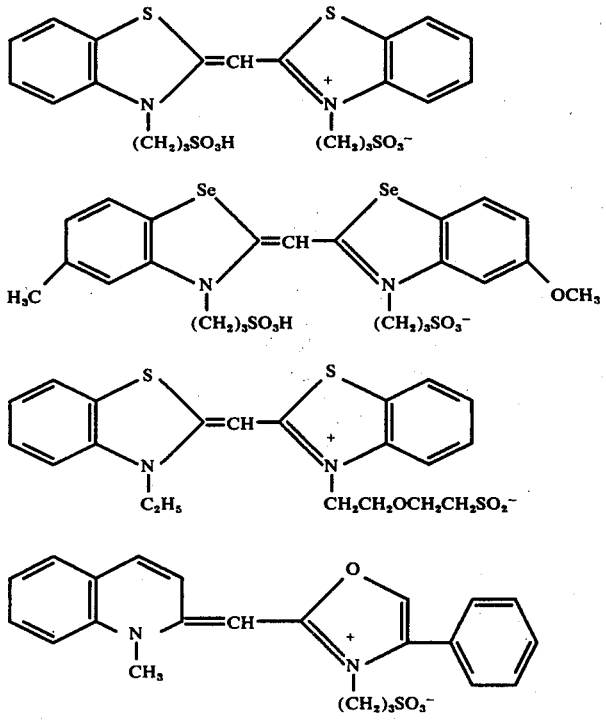

-continued

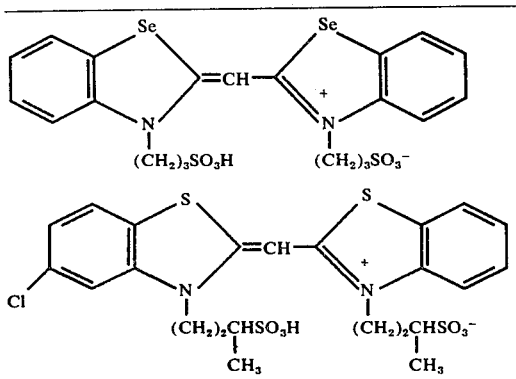

As typical instances of the sensitizing dye used for the green-sensitive dye, there can be mentioned cyanine dyes, merocyanine dyes and composite cyanine dyes such as disclosed in U.S. Pats. 1939,201; 2072,908; 2739,149 and 2945,763. As typical instances of the sensitizing dye used for the red-sensitive dye, there can be mentioned cyanine dyes, merocyanine dyes and composite cyanine dyes such as disclosed in U.S. Pats. No. 2,269,234, No. 2,270,378, No. 2,442,710, No. 2,454,629 and No. 2,776,280. Furthermore, cyanine dyes, merocyanine dyes and composite cyanine dyes such as disclosed in U.S. Pats. No. 2,213,995, No. 2,493,748 and No. 2,519,001 are advantageously used for a blue-sensitive, green-sensitive or red-sensitive emulsion.

A coupler other than the above-mentioned couplers of this invention can be incorporated according to need into the silver halide photosensitive material for color photography according to this invention in order to attain special objects. In this case, it is desired that the coupling rate of the coupler to be incorporated is the same. In case such development inhibitor-releasing coupler or compound is incorporated in a photosensitive emulsion layer, the development inhibitor released in correspondence with the image density at the development step controls the development in said photosensitive emulsion layer in correspondence with the image density to exhibit so called intra-image effects such as control of the image tone, reduction of the image particle size and improvement of the image sharpness. In case the release development inhibitor diffuses into other layer, it exhibits so called inter-image effects such as masking action of inhibiting the development in said other layer in correspondence with the image density in the layer from which the inhibitor has been released and improvement of the color by controlling the development in said other layer in the case of monochromatic exposure. In short, such development inhibitor-releasing coupler or compound is used to attain the above-mentioned two image effects, namely intra-image and inter-image effects.

The silver halide photosensitive material for color photography according to this invention is prepared by forming by coating blue-sensitive, green-sensitive and red-sensitive emulsion layers incorporated with various photographic additives such as mentioned above according to need, on a corona diacharge-treated, flame-treated or ultraviolet-irradiated support optionally through undercoat and intermediate layers. As the support advantageously used in this invention, there can be mentioned, for example, baryta paper, polyethylene-coated paper, polystyrene artificial paper, glass sheet, cellulose acetate, cellulose nitrate, films of polyesters such as polyethylene terephthalate, polyamide films, polycarbonate films, polystyrene films and the like. A suitable support is selected depending on the intended use of the silver halide photosensitive material for color photography. In whatever order respective photosensitive layers may be laminated, the intended effects can be obtained sufficiently in this invention. In the case of a printing photographic photosensitive material, however, it is desired to form blue-sensitive, green-sensitive and red-sensitive emulsion layers in this order from the side of the support.

In the silver halide photosensitive material for color photography according to this invention, a sufficient effect can be obtained even if the thickness of an intermediate layer provided for preventing diffusion of an oxidation product of the coloring developing agent is very small, and in some cases provision of such intermediate layer can be omitted. Of course, it is possible to form an intermediate layer of a suitable thickness optionally for attaining other purpose. Further, such layers as a filter layer, a curl-preventive layer and an anti-halation layer can be combined as structural layers with the photosensitive emulsion layers. Hydrophilic colloids such as mentioned above with respect to the photosensitive emulsion layers can be incorporated as binders in these structural layers. It is also possible to incorporate various photographic additives such as mentioned above into these structural layers.

It is advantageous that the silver halide photosensitive material for color photography according to this invention is light-exposed and then subjected to the color development according to the ordinary color development method customarily adopted for development of ordinary coupler-in-emulsion type silver halide photographic photosensitive materials. In the reverse method, the photosensitive material is first developed with a liquid developer for black-white negatives, subjected to white light exposure or the treatment with a bath containing a fogging agent, and then developed with an alkali liquid developer containing a color developing agent. After the color development, the developed photosensitive material is bleached with a bleaching agent comprising as an oxidant ferricyanide or a ferric salt of an aminopolycarboxylic acid, and then subjected to the fixing treatment with a fixing liquid containing a solvent for silver salts, such as a thiosulfate to remove the silver image and residual silver halide while leaving a dye image. It is possible to conduct the bleach-fixing treatment by employing a bleach-fixing solution of the one-bath type containing an oxidant such as a ferric salt of an aminopolycarboxylic acid and a solvent for silver salts such as a thiosulfate instead of the above-mentioned bleach-fixing solution. Such treatments as washing, stopping and stabilizing treatments can be combined with the above color developing, bleaching, fixing or bleach-fixing treatment. The development process advantageously adopted for development of the silver halide photosensitive material for color photography according to this invention includes, for example, the color developing step, optionally the washing step, the bleach-fixing step, the washing step, optionally the stabilizing step and the drying step. This treating process can be accomplished at such a high temperature as not lower than 30° C. in a very short time. Typical instances of the treating process and each of treating liquids are described below:

| Treating Step (30° C.) | Treating Time |
|---|---|
| color development | 3 minutes and 30 seconds |
| bleach-fixing | 1 minute and 30 seconds |
| washing | 2 minutes |
| stabilization | 1 minute |
| drying | |

| Composition of color Developing Solution | |
|---|---|
| benzyl alcohol | 5.0 ml |
| sodium hexametaphosphate | 2.5 g |
| anhydrous sodium sulfite | 1.9 g |
| sodium bromide | 1.4 g |
| potassium bromide | 0.5 g |
| borax ($Na_2B_4O_7$ $IOH_2O$) | 39.1 g |
| N-ethyl-N-β-methane-sulfonamido-ethyl-4-amino-aniline sulfate | 5.0 g |
| water | balance |
| total | 1 liter |

The pH is adjusted to 10.30 by addition of sodium hydroxide.

| Composition of Bleach-Fixing Solution | |
|---|---|
| iron ammonium ethylenediamine-tetra-acetate | 61.0 g |
| diammonium ethylenediamine-tetra-acetate | 5.0 g |
| ammonium thiosulfate | 124.5 g |
| sodium metabisulfite | 13.3 g |
| anhydrous sodium sulfite | 2.7 g |
| water | balance |
| total | 1 liter |

The pH is adjusted to 6.5 by addition of aqueous ammonia.

| Composition of Stabilizing Solution | |
|---|---|
| glacial acetic acid | 20 ml |
| water | 800 ml |

The pH of the solution is adjusted to 3.5 to 4.0, and water is further added to the solution to make 1 l of the solution.

Primary phenylenediamines and derivatives thereof can be advantageously used as color developing agents for color development of the silver halide photosensitive material for color photography according to this invention. As typical instances of such color developing agent, there can be mentioned N, N-dimethyl -p-phenylenediamine, N, N-diethyl-p-phenylenediamine, N-carbamidomethyl-N-methyl-p-phenylenediamine, N-carbamidomethyl -N-tetrahydrofurfuryl-2-methyl-p-phenylenediamine, N-ethyl -N-carboxymethyl-2-methyl-p-phenylenediamine, N-carbamidomethyl -N-ethyl-2-methyl-p-phenylenediamine, N-ethyl-N-tetrahydrofurfuryl -2-methyl-p-aminophenol, 3-acetylamino-4-aminodimethylaniline, N-ethyl-N-β-methansulfonamidoethyl-4-aminoaniline, N-ethyl-N-β-methanesulfonamidoethyl-3-methyl-4-amino-aniline, N-methyl-N-β-sulfoethylp-phenylenediamine sodium salt, and the like.

In case a bleach-fixing solution containing a ferric salt of an aminopolycarboxylic acid and a thiosulfate is used in the treatment of the silver halide photosensitive material for color photography according to this invention, in order not to cause a problem of environmental pollution, it is preferred to use the bleaching-fixing liquid repeatedly by recovering the bleaching and fixing activities of the liquid used so as to make it re-usable while reducing the amount discharged of the liquid to as low a level as possible. In order to accomplish such regeneration of the treating liquid, it is possible to adopt, for example, a method comprising contacting the used liquid with steel wool to remove from the liquid at least a part of silver ions formed at the treatment step, simultaneously or subsequently blowing oxygen or an oxygen-containing gas into the liquid and thus contacting the liquid with oxygen to convert ferrous ions formed by reduction of the ferfic aminopolycarboxylate to ferric ions, and thereby restoring the oxidation potential of the liquid without decomposition of the thiosulfate. In conducting such regeneration treatment, in order to further improve the effect of recovering the bleaching and fixing activities of the liquid, it is preferred to add a regenerating composition such as disclosed in U.S. Pat. No. 3,700,450.

This invention will now be described in more detail by reference to the following Examples which do not limit the scope of this invention.

EXAMPLE 1

On a support composed of polyethylene paper, the following layers 1 3,5 and 6laminated in due order from the support side together with two intermediate layers (the following layers 2 and 4 ) of 4 dry thickness of 3μ, 2μ, Iμ or 0.5μ, to thereby form 4 kinds of photosensitive materials for color photography, which were used as examples 1 to 4.

Layer I:

A yellow coupler-containing blue-sensitive silver halide emulsion (an emulsion of silver chloroiodobromide including 1 mole % of silver iodide and 80 mole % of silver bromide, which contained 400 g of gelatin per mole of the silver halide and was sensitized by employing the following sensitizing dye

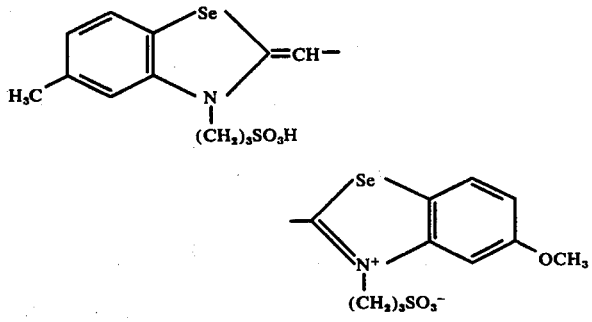

in an amount of $2.5 \times 10^{-4}$ mole per mole of the silver halide, and in which the coupler Y-34, dissolved in dibutyl phthalate in an amount of 2 × 10 mole per mole of the silver halide, was dispersed )was coated so that the amount coated of silver was 400 mg/m².

Layer 2:

Gelatin Layer ( intermediate layer ).

Layer 3:

A magenta coupler-containing, green-sensitive silver halide emulsion ( an emulsion of silver chlorobromide including 80 mole % of silver bromide, which contained 500 g of gelatin per mole of the silver halide and was sensitized by employing the following sensitizing dye

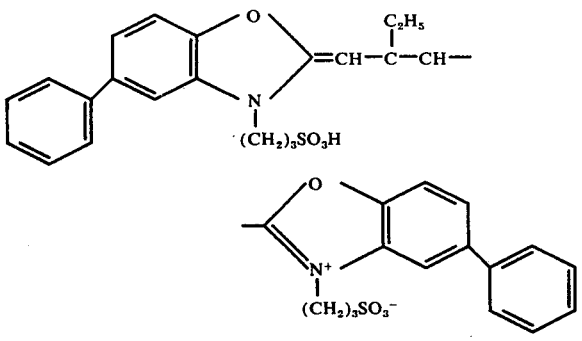

in an amount of $2.5 \times 10^{-4}$ mole per mole of the silver halide, and in which the coupler M-22, dissolved in tricresyl phosphate in an amount of $2 \times 10^{-1}$ mole per mole of the silver halide, was dispersed ) was coated so that the amount coated of silver was 500 mg/m$^2$.

Layer 4:

Gelatin layer ( intermediate layer ).

Layer 5:

A cyan coupler-containing, red-sensitive silver halide emulsion ( an emulsion of silver chlorobromide including 80 mole % of silver bromide, which contained 500 g of gelatin per mole of the silver halide and was sensitized by employing the following sensitizing dye

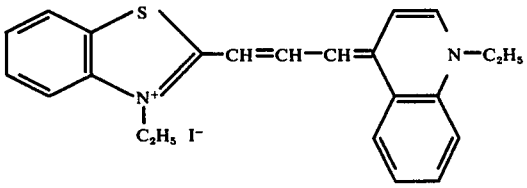

in an amount of $2.5 \times 10^{-4}$ mole per mole of the silver halide, and in which the coupler C-9, dissolved in tricresyl phosphate in an amount of $2 \times 10^{-1}$ mole per mole of the silver halide, was dispersed ) was coated so that the amount coated of silver was 500 mg/g$^2$.

Layer 6

Gelatin layer ( protective layer ) having a dry thickness of 1$\mu$.

Each of silver halide emulsions used for formation of layers 1, 3 and 5 was prepared according to the method disclosed in Japaness Patent Publication No. 7772/71, and each emulsion was chemically sensitized with sodium thiosulfate pentahydrate and was incorporated with 4-hydroxy-6-methyl-1, 3, 3a, 7-tetra-azaindene sodium salt as a stabilizer, bis-(vinyl sulfonylmethyl ) ether as a film-hardening agent and saponin as a coating assistant.

4 kinds of photosensitive materials for color photography differing in the intermediate layer thickness were prepared by forming the laminate structure in the same manner as in the case of samples 1 to 4 and employing as the yellow coupler the following yellow coupler $Y_I$ instead of the coupler Y-34, and they were used as samples 5 to 8.

Yellow coupler $Y_I$ :

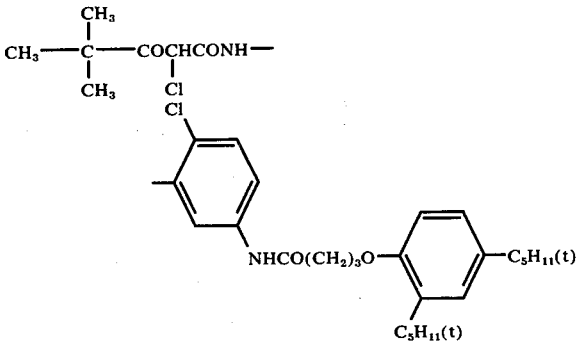

Another 4 kinds of photosensitive materials for color photography differing in the intermediate layer thickness were prepared by forming the laminate structure in the same manner as in the case of samples 1 to 4 and employing the following magenta coupler $M_I$ instead of the coupler M-22, and were used as samples 9 to 12.

Magenta coupler $M_I$ :

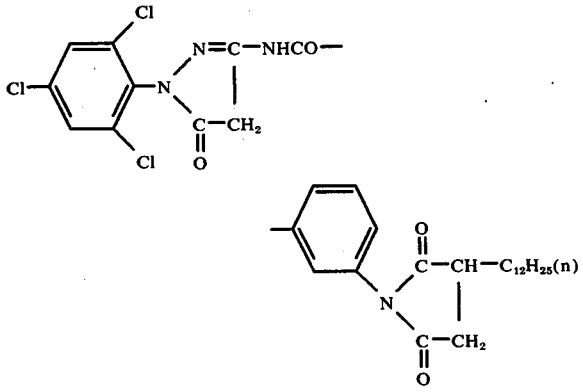

Still another 4 kinds of photosensitive materials for color photography differing in intermediate layer thickness were prepared by forming the laminate structure in the same manner as in the case of samples 1 to 4 and employing the following cyan coupler $C_I$ instead of the cyan coupler C-9, and were used as samples 13 to 16.

Cyan coupler $C_I$ :

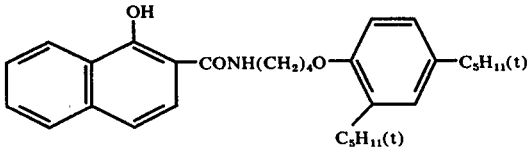

Still another 4 kinds of photosensitive materials for color photography differing in the intermediate layer thickness were prepared by forming the laminate structure in the same manner as in the case of samples 1 to 4 by employing the yellow coupler $Y_I$ instead of the coupler Y-34, the magenta coupler $M_I$ instead of the coupler M-22 and the cyan coupler $Y_I$ instead of the coupler C-9, and were used as samples 17 to 20.

Separately, comparative photosensitive materials were prepared by forming only a layer I including as the yellow coupler the coupler Y-34 or the yellow coupler $Y_I$ on a support composed of polyethylene-coated paper, and they were used as samples 21 and 22. Further, comparative photosensitive materials were prepared by forming only a layer 3 including as the magenta coupler the coupler M-22 or the magenta coupler $M_I$ on a support composed of polyethylene-coated paper and they were used as samples 23 and 24. Moreover, comparative photosensitive materials were prepared by forming only a layer 5 including as the cyan coupler the coupler C-9 or the cyan coupler $C_I$ on a support composed of polyethylene-coated paper, and they were used as samples 25 and 26.

The so prepared 26 kinds of samples were exposed to blue, green and red lights through light wedges by employing a sensitometer ( Model KS-7 manufactured by Konishiroku Photo Industry Co., Ltd. ), and subjected to the color development according to the following treatment steps: Treatment Steps ( 31° C. ) :

| | Treatment Time |
|---|---|
| color development | 3 minutes |
| bleach-fixing | 1 minute |
| washing | 2 minutes |
| stabilization | 1 minute |
| washing | 10 minutes |
| drying (below 95° C.) | |

Compositions of treating solutions used at the above steps are as follows:

| Composition of Color Developing Solution: | |
|---|---|
| N-ethyl-N-β-methanesulfonamidoethyl-3-methyl-4-aminoaniline sulfate | 4.0 g |
| hydroxylamine | 2.0 g |
| potassium carbonate | 25.0 g |
| sodium chloride | 0.1 g |
| sodium bromide | 0.2 g |
| anhydrous sodium sulfite | 2.0 g |
| benzyl alcohol | 10.0 ml |
| polyethyleneglycol (average polymerization degree) | 3.0 ml |
| water | balance |
| total | 1 liter |

The pH was adjusted to 10.0 by addition of sodium hydroxide.

| Composition of Bleach-Fixing Solution: | |
|---|---|
| iron sodium ethylenediaminetetra-acetate | 60.0 g |
| ammonium thiosulfate | 100.0 g |
| sodium bisulfite | 10.0 g |
| sodium metabisulfite | 3.0 g |
| water | balance |
| total | 1 liter |

The pH was adjusted to 6.6 by addition of aqueous ammonia.

| Composition of Stabilizing Solution: | |
|---|---|
| succinic acid | 10.0 g |
| formalin (37 % aqueous solution) | 15.0 ml |
| water | 800 ml |

The pH of the liquid was adjusted to 3.9 by addition of sodium acetate, and water was further added thereto to make 1) of a treating liquid.

Each of dye images formed on the foregoing samples was tested with respect to the reflection density by employing a photoelectric densitometer (Model PDA-60 manufactured by Konishiroku Photo Industry Co., Ltd.) according to the following method, to examine the degree of formation of color turbidity in each photosensitive emulsion layer caused by the influence of the adjacent photosensitive emulsion layer. More specifically, in the yellow color-formed area, the magenta density ( $D_G$) in the light-wedge exposed area corresponding with the yellow density of I.00 measured by a blue filter was measured by means of a green filter, and in the magenta color-formed area, the yellow density ( $D_B$ ) and cyan density ( $D_R$) in the light-wedge exposed area corresponding with the magenta density of I.00 measured by a green filter were measured by means of a blue filter and a red filter, respectively. In the cyan color-formed area, the magenta density ( $D_{GI}$) in the light-wedge exposed area corresponding with the cyan density of I.00 measured by a red filter was measured by means of a green filter. Results are shown in Table I.

Table 1

| Sample No. | Couplers Used Layer 1 | Layer 2 | Layer 3 | Thickness (μ) of Intermediate Layers 2 and 4 | Density: Yellow Color Formed Area ($D_G$) | magenta Color Formed Area $D_B$ | $D_R$ | Cyan Color Formed Area ($D_G$) |
|---|---|---|---|---|---|---|---|---|
| 1 | Y - 34 | M - 22 | C - 9 | 3.0 | 0.14 | 0.31 | 0.11 | 0.32 |
| 2 | " | " | " | 2.0 | 0.14 | 0.31 | 0.12 | 0.32 |
| 3 | " | " | " | 1.0 | 0.14 | 0.33 | 0.12 | 0.34 |
| 4 | " | " | " | 0.3 | 0.15 | 0.34 | 0.13 | 0.36 |
| 5 | $Y_1$ | " | " | 3.0 | 0.16 | 0.31 | 0.11 | 0.32 |
| 6 | " | " | " | 2.0 | 0.17 | 0.31 | 0.12 | 0.33 |
| 7 | " | " | " | 1.0 | 0.19 | 0.34 | 0.13 | 0.34 |
| 8 | " | " | " | 0.3 | 0.22 | 0.35 | 0.13 | 0.35 |
| 9 | Y - 34 | $M_1$ | " | 3.0 | 0.14 | 0.33 | 0.13 | 0.31 |
| 10 | " | " | " | 2.0 | 0.14 | 0.36 | 0.14 | 0.34 |
| 11 | " | " | " | 1.0 | 0.15 | 0.39 | 0.16 | 0.36 |
| 12 | " | " | " | 0.3 | 0.17 | 0.43 | 0.19 | 0.39 |
| 13 | " | M - 22 | $C_1$ | 3.0 | 0.14 | 0.30 | 0.13 | 0.33 |
| 14 | " | " | " | 2.0 | 0.14 | 0.32 | 0.14 | 0.36 |
| 15 | " | " | " | 1.0 | 0.15 | 0.33 | 0.17 | 0.38 |
| 16 | " | " | " | 0.3 | 0.16 | 0.35 | 0.19 | 0.40 |
| 17 | $Y_1$ | $M_1$ | " | 3.0 | 0.16 | 0.35 | 0.13 | 0.32 |
| 18 | " | " | " | 2.0 | 0.18 | 0.38 | 0.15 | 0.37 |
| 19 | " | " | " | 1.0 | 0.20 | 0.42 | 0.18 | 0.39 |
| 20 | " | " | " | 0.3 | 0.24 | 0.46 | 0.20 | 0.41 |
| 21 | Y - 34 | — | — | — | 0.12 | — | — | — |
| 22 | $Y_1$ | — | — | — | 0.11 | — | — | — |
| 23 | — | M - 22 | — | — | — | 0.27 | 0.10 | — |

Table 1-continued

| Sample No. | Couplers Used Layer 1 | Layer 2 | Layer 3 | Thickness ($\mu$) of Intermediate Layers 2 and 4 | Density Yellow Color Formed Area ($D_G$) | magenta Color Formed Area $D_B$ | $D_R$ | Cyan Color Formed Area ($D_G$) |
|---|---|---|---|---|---|---|---|---|
| 24 | — | $M_1$ | — | — | — | 0.28 | 0.10 | — |
| 25 | — | — | C - 9 | — | — | — | — | 0.28 |
| 26 | — | — | $C_1$ | — | — | — | — | 0.28 |

As in apparent from the results shown in Table I, in samples 1 to 4 of this invention, formation of color turbidity was hardly noticeable in dye images formed in respective photosensitive emulsion layers even if the thickness of intermediate layers was extremely reduced. Thus, it will readily be understood that according to this invention clear color images can be obtained even when the thickness of intermediate layers is very small.

EXAMPLE 2

On a support composed of polyethylene-coated paper, the following layers I, 3, 5 and 6 were formed in order from the support side, together with two intermediate layers 2 and 4 having a dry thickness of 2$\mu$, 1$\mu$or 0.2$\mu$, to thereby form 3 kinds of photosensitive materials, which were used as samples 27 to 29.

Layer 1

A yellow coupler -containing, blue-sensitive silver halide emulsion (an emulsion of silver chloroiodobromide including I mole % of silver iodide and 80 mole % of silver bromide, which contained 400 g of gelatin per mole of the silver halide and was sensitized by employing the following sensitizing dye

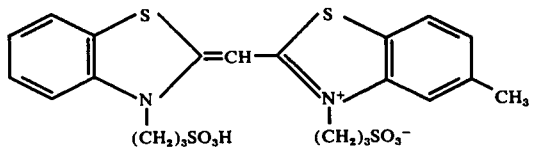

in an amount of $2.5 \times 10^{-4}$ mole per mole of the silver halide. and in which the coupler Y-8, dissolved in dibutyl phthalate in an amount of $2 \times 10^{-1}$ mole per mole of the silver halide was dispersed ) was coated so that the amount coated of silver was 400 mg/m$^2$.

Layer 2

Gelatin layer (intermediate layer).

Layer 3

A magenta coupler-containing, green-sensitive silver halide emulsion (an emulsion of silver chlorobromide including 80 mole % of silver bromide, which contained 500 g of gelatin per mole of the silver halide and was sensitized by employing the following sensitizing dye

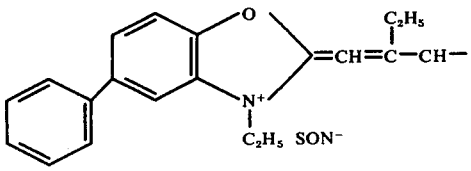

-continued

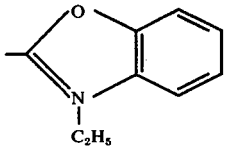

in an amount of $2.5 \times 10^{-4}$ mole per mole of the silver halide, and in which the coupler M-1, dissolved in tricresyl phosphate in an amount of $2 \times 10^{-1}$ mole per mole of the silver halide, was dispersed ) was coated so that the amount coated of silver was 500 mg/m$^2$.

Layer 4

Gelatin layer (intermediate layer).

Layer 5

A cyan coupler-containing, red-sensitive silver halide emulsion ( an emulsion of silver chlorobromide including 80 mole % of silver bromide, which contained 500 g of gelatin per mole of the silver halide and was sensitized by employing the following sensitizing dye

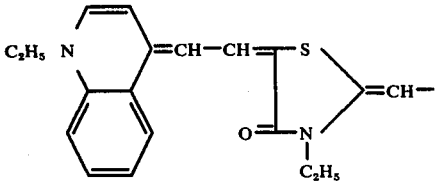

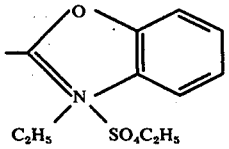

in an amount of $2.5 \times 10^{-4}$ mole per mole of the silver halide, and in which the coupler C-41, dissolved in tricresyl phosphate in an amount of $2 \times 10^{-1}$ mole per mole of the silver halide was dispersed ) was coated so that the amount coated of silver was 500 mg/m$^2$.

Layer 6

Gelatin layer ( protective layer ) having a dry thickness of I$\mu$.

Each of silver halide emulsions used for formation of layers I, 3 and 5 was prepared according to the method disclosed in Photographic Chemistry, Vol. I, page 346 each emulsion was chemically sensitized by using sodium thiosulfate pentahydrate and incorporated with 4-hydroxy-6-methyl-I, 3, 3a, 7-tetra-azaindene sodium salt as a stabilizer, I, 3-bis-( aziridinylsulfonyl ) -propane as a film-hardening agent and saponin as a coating assistant.

Then, 3 kinds of photosensitive materials for color photography differing in the intermediate layer thickness were prepared by forming the laminate structure as in the case of samples 27 to 29 and employing as the yellow coupler the following yellow coupler $Y_2$ instead of the coupler Y-8, and they were used as samples 30 to 32. Yellow coupler $Y_2$ :

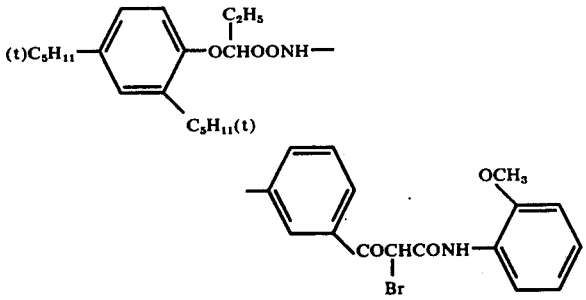

Then, another 3 kinds of photosensitive materials for color photography differing in the intermediate layer thickness were prepared by forming the laminate structure as in the case of samples 27 to 29 and employing the following magenta coupler $M_2$ instead of the coupler M-I, and they were used as samples 33 to 35. Magenta Coupler $M_2$ :

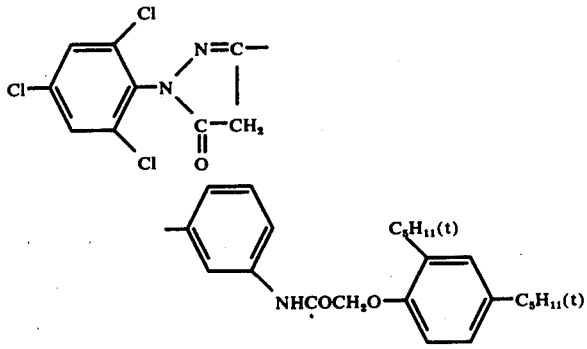

Then, still another 3 kinds of photosensitive materials for color photography differing in the intermediate layer thickness were prepared by forming the laminate structure as in the case of samples 27 to 29 and employing the following cyan coupler $C_2$ instead of the coupler C-4I, and were used as samples 36 to 38.

Cyan Coupler $C_2$

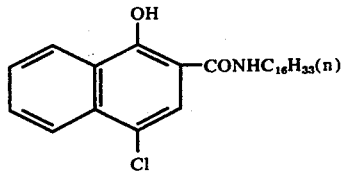

Separately, still another 3 kinds of photosensitive materials for color photography differing in the intermediate layer thickness were prepared by forming the laminate structure as in the case of samples 27 to 29 and employing the yellow coupler $Y_2$ instead of the coupler Y-8, the magenta coupler $M_2$ instead of the coupler M-I and the cyan coupler $C_2$ instead of the coupler C-4I, and were used as samples 39 to 4I.

Comparative photosensitive materials were prepared by forming only a layer I including the coupler Y-8 or yellow coupler $Y_2$ on a support composed of polyethylene-coated paper, and were used as samples 42 and 43. Further, comparative photosensitive materials were prepared by forming only a layer 3 including as the magenta coupler the coupler M-I or magenta coupler $M_2$ on a support composed of polyethylene-coated paper, and they were used as samples 44 and 45. Still further, comparative photosensitive materials were prepared by forming only a layer 5 including as the cyan coupler the coupler C-4I or coupler$C_2$ on a support composed of polyethylene-coated paper, and they were used as samples 46 and 47.

The so prepared 2I samples were exposed to blue, green and red lights through light wedges by employing a sensitometer, and the exposed samples were subjected to the color development according to the same treatment steps as in Example I by using the same treating liquids as used in Example I. The reflection density of each of dye images formed on these samples was measured in the same manner as in Example I to examine the color turbidity in each photosensitive emulsion layer caused by the influence of the adjacent photosensitive emulsion layer. Results are shown in Table 2.

Table 2

| Sample No. | Couplers Used Layer 1 | Layer 3 | Layer 5 | Thickness ($\mu$) of Intermediate Layers 2 and 4 | Density: Yellow Color Formed Area ($D_G$) | Magenta Color Formed Area $D_B$ | $D_K$ | Cyan Color Formed Area ($D_G$) |
|---|---|---|---|---|---|---|---|---|
| 27 | Y - 8 | M - 1 | C - 41 | 2.0 | 0.12 | 0.28 | 0.12 | 0.26 |
| 28 | " | " | " | 1.0 | 0.12 | 0.28 | 0.12 | 0.27 |
| 29 | " | " | " | 0.2 | 0.14 | 0.29 | 0.14 | 0.29 |
| 30 | $Y_2$ | " | " | 2.0 | 0.15 | 0.28 | 0.12 | 0.25 |
| 31 | " | " | " | 1.0 | 0.17 | 0.29 | 0.13 | 0.26 |
| 32 | " | " | " | 0.2 | 0.22 | 0.30 | 0.14 | 0.29 |
| 33 | Y - 8 | $M_2$ | " | 2.0 | 0.12 | 0.39 | 0.13 | 0.27 |
| 34 | " | " | " | 1.0 | 0.13 | 0.42 | 0.15 | 0.29 |
| 35 | " | " | " | 0.2 | 0.14 | 0.48 | 0.16 | 0.30 |
| 36 | " | M -1 | $C_2$ | 2.0 | 0.12 | 0.29 | 0.15 | 0.20 |
| 37 | " | " | " | 1.0 | 0.13 | 0.30 | 0.19 | 0.25 |
| 38 | " | " | " | 0.2 | 0.13 | 0.31 | 0.23 | 0.31 |
| 39 | $Y_2$ | $M_2$ | " | 2.0 | 0.15 | 0.40 | 0.16 | 0.22 |
| 40 | " | " | " | 1.0 | 0.18 | 0.45 | 0.21 | 0.27 |
| 41 | " | " | " | 0.2 | 0.29 | 0.50 | 0.24 | 0.33 |
| 42 | Y - 8 | — | — | — | 0.11 | — | — | — |
| 43 | $Y_2$ | — | — | — | 0.19 | — | — | — |
| 44 | — | M - 1 | — | — | — | 0.26 | 0.10 | — |
| 45 | — | $M_2$ | — | — | — | 0.38 | 0.11 | — |
| 46 | — | — | C - 41 | — | — | — | — | 0.24 |

Table 2-continued

| Sample No. | Couplers Used Layer 1 | Layer 3 | Layer 5 | Thickness (μ) of Intermediate Layers 2 and 4 | Density Yellow Color Formed Area ($D_G$) | Magenta Color Formed Area $D_B$ | $D_K$ | Cyan Color Formed Area ($D_G$) |
|---|---|---|---|---|---|---|---|---|
| 47 | — | — | $C_2$ | — | — | — | — | 0.18 |

As is apparent from the results shown in Table 2, in samples 27 to 29 of this invention, as in the case of samples I to 4 of Example I, formation of color turbidity was hardly noticeable in dye images formed in respective photosensitive emulsion layers even if the thickness of intermediate layers was extremely reduced. Thus, it will readily be understood that according to this invention clear color images can be obtained even when the thickness of intermediate layers is very small.

EXAMPLE 3

On a support composed of polyethylene-coated paper, the following layers I, 3, 5 and 6 were formed in order from the support side, together with two intermediate layers 2 and 4 having a dry thickness of 2μ, 1μor 0.2μ, to thereby form 3 kinds of photosensitive materials, which were used a samples 48 to 50.

Layer 1

A yellow coupler-containing, blue-sensitive silver halide emulsion ( an emulsion of silver bromide, which contained 400 g of gelatin per mole of the silver halide and was sensitized by employing the following sensitizing dye

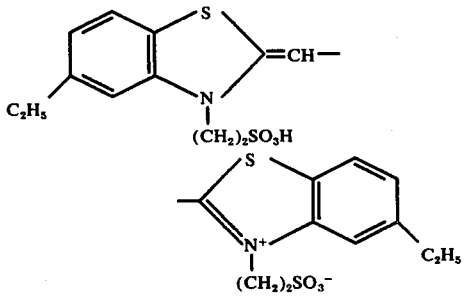

in an amount of $2.5 \times 10^{-4}$ mole per mole of the silver halide, and in which the coupler Y-44 and the following yellow coupler Y-DIR, dissolved in dibutyl phthalate in amounts of $1.8 \times 10^{-1}$ mole and $0.2 \times 10^{-1}$ mole, respectively, per mole of the silver halide were dispersed) was coated so that the amount of silver was 400 mg/m$^2$.

Yellow Coupler Y-DIR:

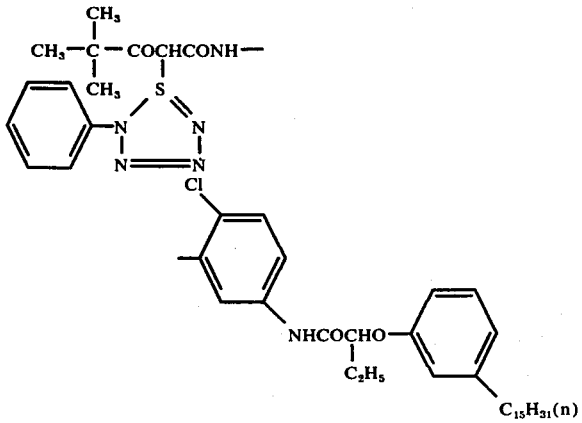

Layer 2

Gelatin layer ( intermediate layer ).

Layer 3

A magenta coupler -containing, green-sensitive silver halide emulsion ( an emulsion of silver chlorobromide including 75 mole % of silver bromide, which was sensitized by employing the sensitizing dye used in the layer 3 of Example 2, in an amount of $2.5 \times 10^{-4}$ mole per mole of the silver halide, and in which the coupler M-13 and the following magenta coupler M-DIR, dissolved in tricresyl phosphate in amounts of $1.8 \times 10^{-1}$ mole and $0.2 \times 10^{-1}$mole, respectively, per mole of the silver halide were dispersed ) was coated 500 mg/m$^2$F silner.

Magneta Coupler M-DIR:

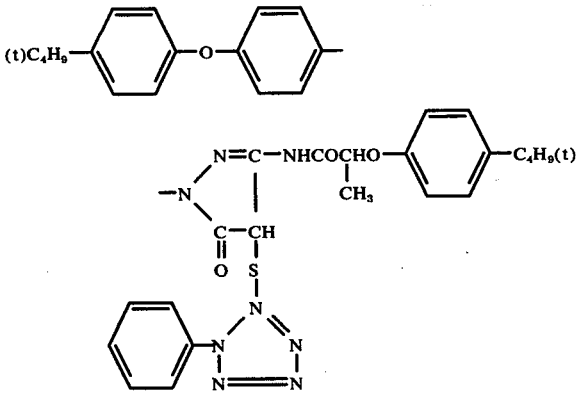

Layer 4

Gelatin layer ( intermediate layer ).

Layer 5

A cyan coupler-containing, red-sensitive silver halide emulsion ( an emulsion of silver chlorobromide including 75 mole % of silver bromide, which contained 500 g of gelatin per mole of the silver halide and was sensitized by employing the sensitizing dye used in the layer 5 of Example 2, in an amount of $2.5 \times 10^{-4}$ mole per mole of the silver halide, and in which the coupler C-7 and the following cyan coupler C- DIR, dissolved in tricresyl phosphate in amounts of $1.8 \times 10^{-1}$ mole and $0.2 \times 10^{-1}$ mole, respectively, per mole of the silver halide, were dispersed ) was coated so that the amount coated of silver was 500 mg/m$^2$.

Cyan Coupler C-DIR:

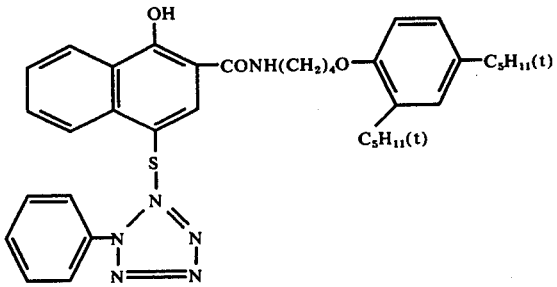

Layer 6

Gelatin layer ( protective layer ) having a thickness of 1$\mu$.

Each of silver halide emulsions used for formation of layers I, 3 and 5 was prepared according to the method disclosed in Photographic Chemistry, Vol. I, pages 344 to 350 published by Fountain Press), and each emulsion was chemically sensitized by employing sodium thiosulfate pentahydrate and incorporated with 4-hydroxy-6-methyl-I, 3, 3a, 7-tetra-azaindene sodium salt as a stabilizer, 2, 5-dimethylisoxaolium perchlorate as a film-hardening agent and saponin as a coating assistant.

Then, 3 kinds of photosensitive materials for color photography differing in the intermediate layer thickness were prepared by forming the laminate structure as in the case of samples 48 to 50 and employing the following yellow coupler $Y_3$ instead of the coupler Y-44, and were used as samples 51 to 53. Coupler $Y_3$ :

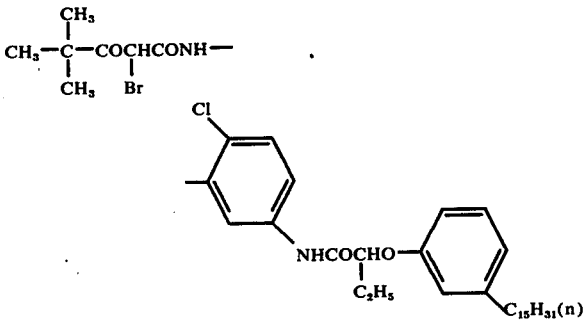

Then, another 3 kinds of photosensitive materials for color photography differing in the intermediate layer thickness were prepared by forming the laminate structure as in the case of samples 48 to 50 and employing the following magenta coupler $M_3$ instead of the coupler M-13, and were used as samples 54 to 56. Coupler $M_3$ :

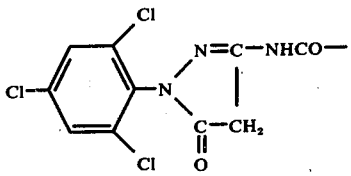

-continued

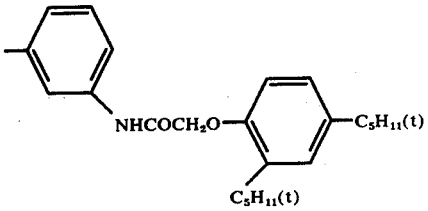

Then, still another 3 kinds of photosensitive materials for color photography differing in the intermediate layer thickness were prepared by forming the laminate structure as in the case of samples 48 to 50 and employing the following cyan coupler $C_3$ instead of the coupler C-7, and were used as samples 57 to 59. Coupler $C_3$ :

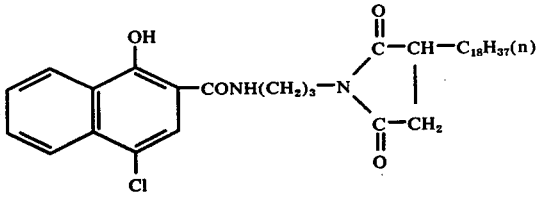

Then, still another 3kinds of photosensitive materials for color photography differing in the intermediate layer thickness were prepared by forming the laminate structure as in samples 48 to 50 and employing the yellow coupler $Y_3$ instead of the coupler Y-44, the magenta coupler $M_3$ instead of the coupler M-I3 and the cyan coupler $C_3$ instead of the coupler C-7, and were used as samples 60 to 62.

Separately, comparative photosensitive materials were prepared by forming only a layer 1 including as the yellow coupler a combination of the couplers Y-44 and Y-DIR or a combination of the couplers $Y_3$ and Y-DIR on a polyethylene-coated paper support, and were used as samples 63 and 64, Another comparative group of photosensitive materials were prepared by forming only a layer 3 including as the magenta coupler a combination of the couplers M-13 and M-DIR or a combination of the couplers $M_3$ and M-DIR on a polyethylene-coated paper support, and were used as samples 65 and 66. Still another comparative group F photosensitive materials were prepared by forming only a layer 5 including as the cyan coupler a combination of the couplers C-7 and C-DIR or a combination of the couplers $C_3$ and C-DIR, and were used as samples 67 and 68.

The so prepared 2I samples were exposed to blue, green and red lights through light wedges by employing a sensitometer, and were subjected to the color development according to the same treatment steps as in Example I by employing the same treating liquids as used in Example I. The reflection density of each of dye images formed on these samples was measured in the same manner as in Example I to examine the color turbidity formed in each photosensitive emulsion layer by the influence of the adjacent photosensitive emulsion layer. Results are shown in Table 3.

Table 3

| Sample No. | Couplers Used Layer 1 | Layer 3 | Layer 5 | Thickness ($\mu$) of Intermediate Layer | Density: Yellow Color Formed Area ($D_G$) | Magenta Color Formed Area $D_B$ | $D_R$ | Cyan Color Formed Area ($D_G$) |
|---|---|---|---|---|---|---|---|---|
| 48 | Y-44 | M-13 | C-7 | 2.0 | 0.13 | 0.25 | 0.11 | 0.25 |
| 49 | " | " | " | 1.0 | 0.13 | 0.25 | 0.11 | 0.25 |
| 50 | " | " | " | 0.2 | 0.13 | 0.25 | 0.11 | 0.25 |
| 51 | $Y_3$ | " | " | 2.0 | 0.13 | 0.25 | 0.11 | 0.25 |
| 52 | " | " | " | 1.0 | 0.14 | 0.25 | 0.11 | 0.25 |
| 53 | " | " | " | 0.2 | 0.16 | 0.26 | 0.11 | 0.25 |
| 54 | Y-44 | $M_3$ | " | 2.0 | 0.13 | 0.34 | 0.11 | 0.25 |
| 55 | " | " | " | 1.0 | 0.13 | 0.36 | 0.11 | 0.25 |
| 56 | " | " | " | 0.2 | 0.14 | 0.38 | 0.12 | 0.26 |
| 57 | " | M-13 | $C_3$ | 2.0 | 0.13 | 0.25 | 0.11 | 0.29 |
| 58 | " | " | " | 1.0 | 0.13 | 0.25 | 0.12 | 0.30 |
| 59 | " | " | " | 0.2 | 0.13 | 0.25 | 0.15 | 0.33 |
| 60 | $Y_3$ | $M_3$ | " | 2.0 | 0.13 | 0.34 | 0.12 | 0.31 |
| 61 | " | " | " | 1.0 | 0.15 | 0.34 | 0.13 | 0.34 |
| 62 | " | " | " | 0.2 | 0.17 | 0.39 | 0.17 | 0.38 |
| 63 | Y-44 | — | — | — | 0.13 | — | — | — |
| 64 | $Y_3$ | — | — | — | 0.12 | — | — | — |
| 65 | — | M-13 | — | — | — | 0.25 | 11 | — |
| 66 | — | $M_3$ | — | — | — | 0.34 | 11 | — |
| 67 | — | — | C-7 | — | — | — | — | 0.21 |
| 68 | — | — | $C_3$ | — | — | — | — | 0.28 |

As is apparent from the results shown in Table 3, in samples 48 to 50 of this invention, as in the case of samples 1 to 4 of Example 1, formation of color turbidity was hardly observed in dye images formed in respective photosensitive emulsion layers even if the thickness of intermediate layers was extremely reduced. Thus, it will readily be understood that according to this invention clear color images can be obtained even when the thickness of intermediate layers is very small.

EXAMPLE 4

On a polyethylene terephthalate film, the following layers 1, 3, 5 and 6 were formed in due order from the support side, together with an intermediate layer 2 having a dry thickness of 2$\mu$, 1$\mu$ or 0.1$\mu$, to thereby form 3 kinds of photosensitive materials for color photography, which were used as samples 69 to 71.

Layer 1

A cyan coupler containing, red-sensitive silver halide emulsion ( a highly sensitive emulsion of silver iodobromide including 7 mole % of silver iodide, which contained 200 g of gelatin per mole of the silver halide and was sensitized by employing the following sensitizing dye

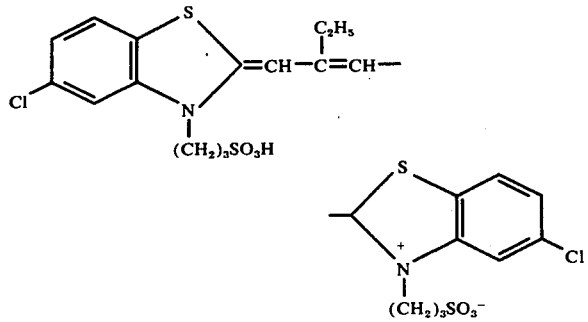

in an amount of $2.5 \times 10^{-4}$ mole per mole of the silver halide, and in which the coupler C-11, dissolved in a mixed solvent of tricresyl phosphate and ethyl acetate in an amount of $0.7 \times 10^{-1}$ mole per mole of the silver halide, was dispersed ) was coated so that the amount coated of silver was 2000 mg/m$^2$.

Layer 2

Gelatin layer ( intermediate layer ).

Layer 3

A magenta coupler-containing, green-sensitive silver halide emulsion ( a highly sensitive emulsion of silver iodobromide including 7 mole % of silver iodide, which contained 200 g of gelatin per mole of the silver halide and was sensitized by employing the following sensitizing dye

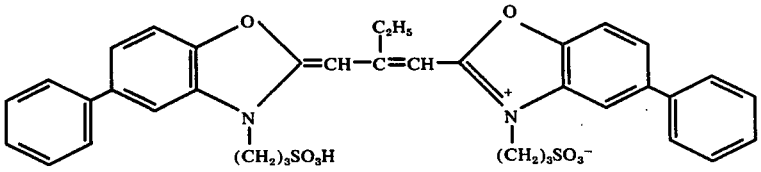

in an amount of $2.5 \times 10^{-4}$ mole per mole of the silver halide, and in which the coupler M-11, dissolved in a mixed solvent of tricresyl phosphate and ethyl acetate in an amount of $0.7 \times 10^{-1}$ mole per mole of the silver halide, was dispersed ) was coated so that the amount coated of silver was 2000 mg/m$^2$.

Layer 4

A yellow filter layer ( gelatin layer containing a dye carrier composed of a polymer having the guanidylketimine structure and the following yellow dye

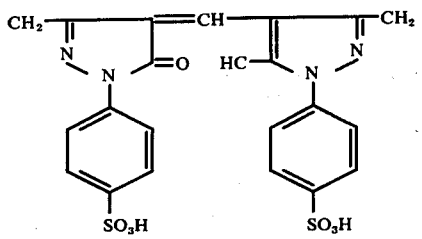

in combination ) having a dry thickness of 0.3$\mu$.

Layer 5

A yellow coupler-containing, blue-sensitive silver halide emulsion ( a highly sensitive emulsion of silver iodobromide including 7 mole % silver iodide, which contained 200 g of gelatin per mole of the silver halide and in which the coupler Y-77, dissolved in a mixed solvent of dibutyl phthalate and ethyl acetate in an amount of $1.5 \times 10^{-1}$ mole per mole of the silver halide, was dispersed ) was coated so that the amount coated of silver was 1500 mg/m$^2$.

Layer 6

Gelatin layer ( protective layer ) having a dry thickness of 1$\mu$.

Each of silver halide emulsions used for formation of layers 1, 3 and 5 was prepared by the neutral method, and each emulsion was chemically sensitized with potassium chloroaurate and sodium thiosulfate pentahydrate and incorporated with 4-hydroxy-6-methyl-1, 3, 3a, 7-tetra-azaindene sodium salt as a stabilizer, N, N', N''-triacryloyl-hexahydro-Striazine as a film-hardening agent and saponin as a coating assistant.

Then, 3 kinds of photosensitive materials for color photography differing in the intermediate layer thickness were prepared by forming the laminate structure as in case of samples 69 to 71 and employing as the yellow coupler the following yellow coupler $Y_4$ instead of the coupler Y-77, and they were used as samples 72 to 74. Yellow coupler $Y_4$ :

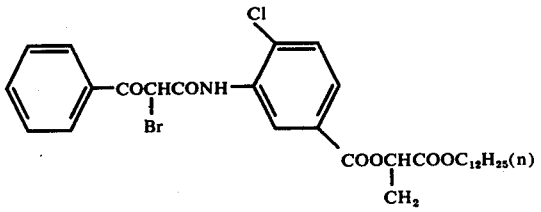

Then, another 3 kinds of photosensitive materials for color photography differing in the intermediate layer thickness were prepared by forming the laminate structure as in the case of samples 69 to 71 and employing the following megenta coupler $M_4$ instead of the coupler M-11, and were used as samples 75 to 77.

Magenta coupler $M_4$ :

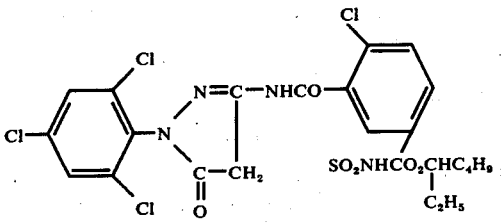

Then, still another 3 kinds of photosensitive materials for color photography differing in the intermediate layer thickness were prepared by forming the laminate structure as in the case of samples 69 to 71 and employing the following cyan coupler $C_4$ instead of the coupler C-11, and were used as samples 78 to 30. Cyan coupler $C_4$:

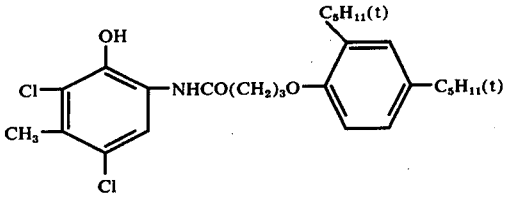

Then still another 3 kinds of photosensitive materials for color photography differing in the intermediate layer thickness were prepared by forming the laminate structure as in the case of samples 69 to 71 and employing the yellow coupler $C_4$ instead of the coupler Y-77, the magenta coupler $M_4$ instead of the coupler M-11 and the cyan coupler $C_4$ instead of the coupler C-11, and they were used as samples 81 to 83.

Comparative photosensitive materials were prepared by forming only a layer 5 including as the yellow coupler the coupler Y-77 or the yellow coupler $Y_4$ on a polyethylene terephthalate film, and were used as samples 84 and 85. Another set of comparative photosensitive materials was prepared by forming only a layer 3 including as the magenta coupler the coupler M-11 or the magenta coupler $M_4$ on a polyethylene terephthalate film, and they were used as samples 86 and 87. Still another set of comparative photosensitive materials were prepared by forming only a layer 1 including as the cyan coupler the coupler C-11 or the cyan coupler $C_4$ on a polyethylene terephthalate film, and were used as samples 88 and 89.

The so formed 21 samples were exposed to blue, green and red lights through light wedges by employing a densitometer, and they were subjected to the color development according to the following treatment steps:

| Treatment Steps (38° C.) | Treatment Time |
|---|---|
| color development | 3 minutes and 15 seconds |
| bleach-fixing | 6 minutes |
| washing | 3 minutes and 15 seconds |
| stabilization | 1 minute and 30 seconds |
| drying (below 80° C.) | |

Compositions of treating liquids used at the above treating steps are as follows:

| Composition of Color Developing Solution: | |
|---|---|
| N-methyl-N-$\beta$-hydroxyethyl-3-methyl-4-aminoaniline sulfate | 5.0 g |
| hydroxylamine sulfate | 2.0 g |
| anhydrous potassium carbonate | 26.0 g |
| anhydrous sodium bicarbonate | 3.5 g |
| potassium sulfite dihydrate | 18.0 g |
| potassium bromide | 1.3 g |
| sodium chloride | 0.2 g |
| sodium nitrilotriacetate monohydrate | 2.0 g |
| potassium hydroxide | 0.4 g |
| water | balance |
| total | 1 liter |

The pH of the liquid was adjusted to 10.5 by addition of sodium hydroxide.

| Composition of Bleach-Fixing Solution: | |
|---|---|
| iron sodium ethylenediamine-tetra-acetate | 180 g |
| ammonium thiocyanate | 200 g |
| water | balance |
| total | 1 liter |

The pH of the liquid was adjusted to 5.0 by addition of aqueous ammonia.

| Composition of Stabilizing Liquid: | |
|---|---|
| formalin (37% aqueous solution) | 1.5 ml |
| konidaz (product of kenishirsku Photo Industry Co., Ltd.) | 7.5 ml |
| water | balance |
| total | 1 liter |

The density of each of the dye images formed on the samples was measured in the smae manner as in Example 1 except that the density was determined as the transmission density, to examine formation of color turbidity in each photosensitive emulsion layer caused by the influence of the adjacent photosensitive emulsion layer. Results are shown in Table 4.

Table 4

| Sample No. | Couplers Used Layer 5 | Layer 3 | Layer 1 | Thickness (μ) of Intermediate Layer | Density: Yellow Color Formed Area ($D_G$) | Magenta Color Formed Area $D_B$ | $D_R$ | Cyan Color Formed Area ($D_G$) |
|---|---|---|---|---|---|---|---|---|
| 69 | Y-77 | M-11 | C-11 | 2.0 | 0.10 | 0.29 | 0.08 | 0.23 |
| 70 | " | " | " | 1.0 | 0.11 | 0.29 | 0.08 | 0.23 |
| 71 | " | " | " | 0.2 | 0.12 | 0.29 | 0.08 | 0.24 |
| 72 | $Y_4$ | " | " | 2.0 | 0.10 | 0.30 | 0.08 | 0.23 |
| 73 | " | " | " | 1.0 | 0.13 | 0.30 | 0.08 | 0.23 |
| 74 | " | " | " | 0.2 | 0.17 | 0.32 | 0.08 | 0.24 |
| 75 | Y-77 | $M_4$ | " | 2.0 | 0.10 | 0.39 | 0.09 | 0.25 |
| 76 | " | " | " | 1.0 | 0.11 | 0.43 | 0.11 | 0.26 |
| 77 | " | " | " | 0.2 | 0.13 | 0.51 | 0.13 | 0.27 |
| 78 | " | M-11 | $C_4$ | 2.0 | 0.10 | 0.30 | 0.10 | 0.27 |
| 79 | " | " | " | 1.0 | 0.10 | 0.31 | 0.13 | 0.29 |
| 80 | " | " | " | 0.2 | 0.11 | 0.31 | 0.15 | 0.32 |
| 81 | $Y_4$ | $M_4$ | " | 2.0 | 0.12 | 0.40 | 0.11 | 0.29 |
| 82 | " | " | " | 1.0 | 0.15 | 0.44 | 0.15 | 0.32 |
| 83 | " | " | " | 0.2 | 0.19 | 0.52 | 0.19 | 0.36 |
| 84 | Y-77 | — | — | — | 0.09 | — | — | — |
| 85 | $Y_4$ | — | — | — | 0.08 | — | — | — |
| 86 | — | M-11 | — | — | — | 0.28 | 0.08 | — |
| 87 | — | $M_4$ | — | — | — | 0.38 | 0.09 | — |
| 88 | — | — | C-11 | — | — | — | — | 0.21 |
| 89 | — | — | $C_4$ | — | — | — | — | 0.23 |

As is apparent from the results shown in Table 4, in samples 69 to 71 of this invention, as in the case of samples of this invention formed in Examples 1, 2 and 3, formation of color turbidity was hardly observed in dye images formed in respective photosensitive emulsion layers even if the thickness of the intermediate layer was extremely reduced. Thus, it will readily be understood that according to this invention clear color images can be obtained even when the thickness of an intermediate layer is very small.

What is claimed is:

1. A silver halide photosensitive material comprising a support; a blue-sensitive silver halide emulsion layer containing a yellow coupler represented by the following general formula

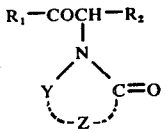

[I]

where $R_1$ stands for a group selected from the groups consisting of an alkyl group, alkenyl group, aryl group and heterocyclic group, each of which may be substituted with a group taken from the class consisting of $C_nH_{2n+1}O$-, wherein $n$ = 1 to 18, $C_{15}H_{31}CONH$-,

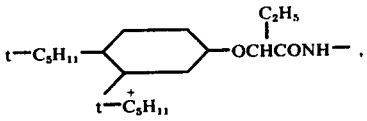

and

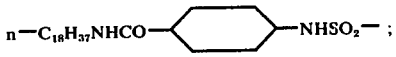

$R_2$ stands for a group selected from a cyano group and N-phenylcarbamyl group which may be substituted with a substituent taken from the class consisting of fluorine, chlorine,

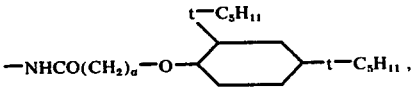

wherein a = 1 to 4,

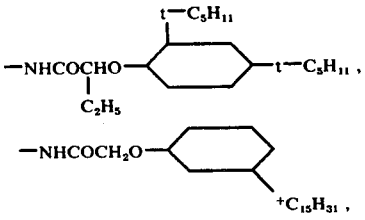

-continued

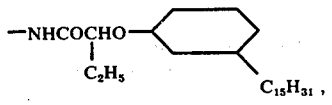

1 —COOM, where M = sodium or potassium,

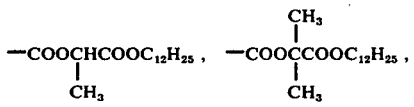

$COOCH_2COOC_{12}H_{25}$,

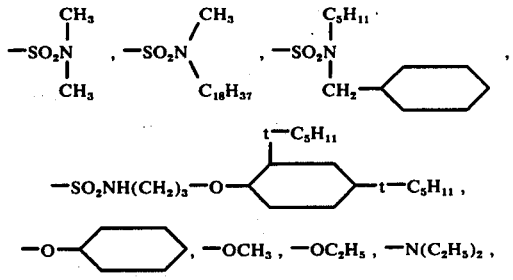

$-COOC_bH_{2b+1}$, wherein b = 1 to 14,

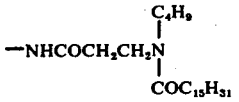

$-NHCOC_{15}H_{31}$, and

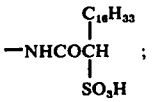

Y stands for a group selected from the groups consisting of —CO—, —$SO_2$—, —N=, —CH=, and —C , and Z stands for nonmetallic atoms required to complete a 4-to 6-membered heterocyclic nucleus;

a green-sensitive silver halide emulsion layer containing a magenta coupler represented by the following general formula

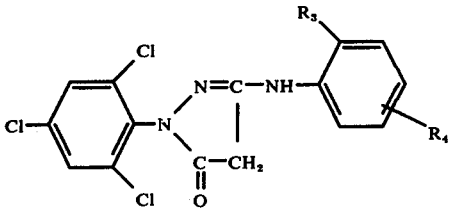

[II]

wherein $R_3$ stands for a hydrogen atom, halogen atom or a group selected from the groups consisting of a nitro group, alkyl group, alkoxy group and acylamino group, and $R_4$ stands for a hydrogen atom, halogen atom, or mono-valent organic residue;

a red-sensitive silver halide emulsion layer containing a cyan coupler represented by the following general formula

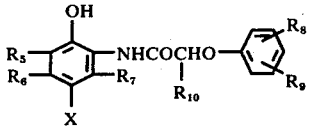

[III]

wherein $R_5$, $R_6$ and $R_7$ stand for a hydrogen atom, halogen atom or a group selected from the groups consisting of an alkyl group, aryl group and alkoxy group, $R_8$ and $R_9$ stand for a hydrogen atom, an alkyl group or an alkoxy group, $R_{10}$ stands for a hydrogen atom or an alkyl group, and X stands for an atom or group splittable upon coupling; and said three layers being formed on said support.

2. A silver halide photosensitive material according to claim 1, wherein said blue sensitive silver halide emulsion layer contains a yellow coupler represented by the following formula

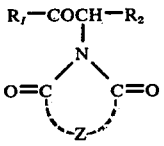

[IV]

3. A silver halide photosensitive material according to claim 1 wherein said blue-sensitive silver halide emulsion layer contains a yellow coupler represented by the following formula

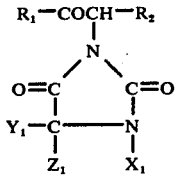

[V]

wherein $X_1$ stands for a hydrogen atom or a group selected from the groups consisting of an alkyl group, aryl group and aralkyl group, which may be substituted with chlorine, —$OCH_3$ or $OC_2H_5$, $Y_1$ and $Z_1$ each stands for a hydrogen atom or a group selected from an alkyl, aryl, and alkoxy which may be substituted with —$OC_2H_5$, and $Y_1$ and $Z_1$ together can be 0.

4. A silver halide photosensitive material according to claim 1 wherein said blue-sensitive silver halide emulsion layer contains a yellow coupler represented by the following formula

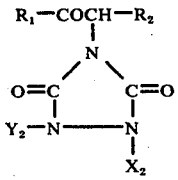

[VI]

wherein $X_2$ and $Y_2$ each stands for a hydrogen atom or a group selected from the groups consisting of an alkyl group, aralkyl group and carboxy alkyl group which may be substituted with Cl, $X_2$ may be substituted with $-CH_3$ and $Y_2$ may be substituted with $-C_4H_9$.

5. A silver halide photosensitive material according to claim 1 wherein said green-sensitive silver halide emulsion layer contains a magenta coupler represented by the following formula

[VII]

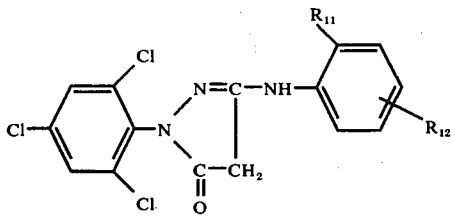

where $R_{11}$ stands for a hydrogen atom or chlorine atom and $R_{12}$ stands for

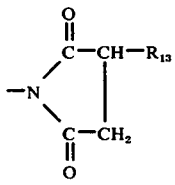

in which $R_{13}$ stands for alkyl, alkenyl, or thioalkyl.

6. A silver halide photosensitive material according to claim 1, wherein said red-sensitive emulsion layer contains a cyan coupler represented by the following formula

[VIII]

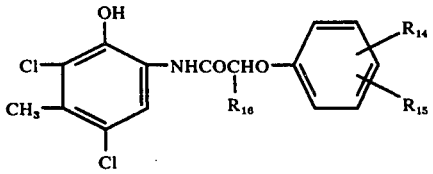

wherein $R_{14}$, $R_{15}$ and $R_{16}$ each stands for an alkyl group.

7. A silver halide photosensitive material layer according to claim 1 wherein said blue-sensitive emulsion layer contains a yellow coupler represented by the formula

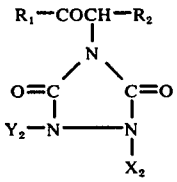

where $X_2$ and $Y_2$ each stands for a hydrogen atom or a group selected from the class consisting of an alkyl group, aralkyl group and carboxy alkyl group which may be substituted with chlorine, $X_2$ may be substituted with $-CH_3$ and $Y_2$ may be substituted with $-C_4H_9$;

said green-sensitive emulsion layer contains a magenta coupler represented by the formula

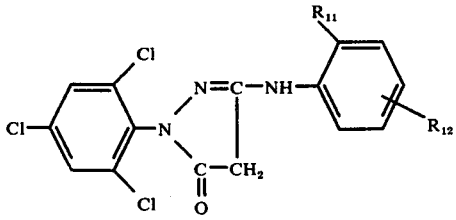

wherein $R_{11}$ stands for a hydrogen atom or chlorine atom and $R_{12}$ stands for

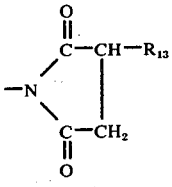

in which $R_{13}$ stands for alkyl, alkenyl, or thioalkyl; and said red-sensitive emulsion layer contains a cyan coupler represented by the formula

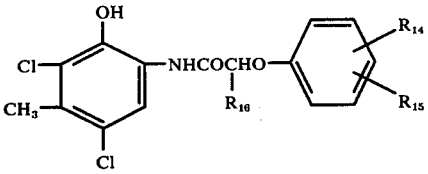

wherein $R_{14}$, $R_{15}$ and $R_{16}$ each stands for an alkyl group.

8. A silver halide photosensitive material according to claim 1 wherein said blue-sensitive emulsion layer contains a yellow coupler represented by the formula

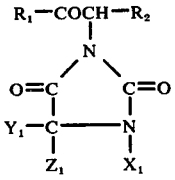

wherein $R_1$ and $R_1$ stand for a group defined in claim 1, $X_1$ stand for a hydrogen atom or a group selected from an alkyl, aryl and aralkyl, which may be substituted with chlorine, $-OC_2H_5$ or $-OCH_3$, $Y_1$ and $Z_1$ each stand for hydrogen or a group selected from an alkyl, aryl and alkoxy, which may be substituted with $OC_2H_5$ and $Y_1$ and $Z_1$ together can be O;

said green-sensitive emulsion layer contains a magenta coupler represented by the formula

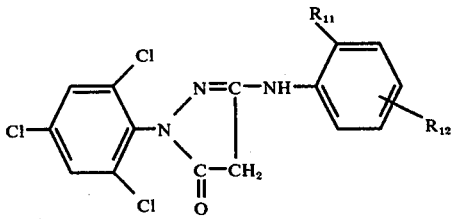

wherein $R_{11}$ stands for a hydrogen atom or chlorine atom and $R_{12}$ stands for

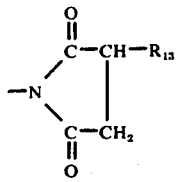
in which $R_{13}$ stands for an alkyl group, alkenyl group or thioalkyl group;
and said red-sensitive emulsion layer contains a cyan coupler represented by the formula
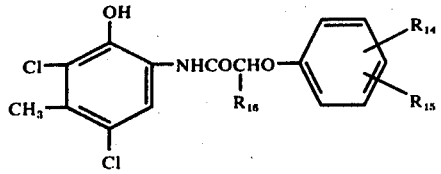
wherein $R_{14}$, $R_{15}$ and $R_{16}$ each stand for an alkyl group.
* * * * *